US009891545B2

(12) United States Patent
Anno et al.

(10) Patent No.: US 9,891,545 B2
(45) Date of Patent: Feb. 13, 2018

(54) ELECTROSTATIC CHARGE IMAGE DEVELOPER, DEVELOPER CARTRIDGE, AND PROCESS CARTRIDGE

(71) Applicant: FUJI XEROX CO., LTD., Tokyo (JP)

(72) Inventors: Shintaro Anno, Kanagawa (JP); Motoko Sakai, Kanagawa (JP); Takuro Watanabe, Kanagawa (JP); Shuji Sato, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/223,810

(22) Filed: Jul. 29, 2016

(65) Prior Publication Data

US 2017/0285504 A1 Oct. 5, 2017

(30) Foreign Application Priority Data

Mar. 29, 2016 (JP) ..... 2016-065798

(51) Int. Cl.
*G03G 9/113* (2006.01)
*G03G 9/09* (2006.01)
*G03G 15/08* (2006.01)

(52) U.S. Cl.
CPC ..... *G03G 9/1136* (2013.01); *G03G 9/0902* (2013.01); *G03G 9/0926* (2013.01); *G03G 15/0865* (2013.01)

(58) Field of Classification Search
CPC .. G03G 9/1136; G03G 9/0902; G03G 9/0926; G03G 9/0825
USPC ..... 430/111.35, 111.32
See application file for complete search history.

(56) References Cited

U.S. PATENT DOCUMENTS 6,087,057 A * 7/2000 Hakata ..... G03G 9/1136 428/405
2012/0237868 A1 9/2012 Yamada et al.
2014/0234765 A1* 8/2014 Hirai ..... G03G 15/0865 430/105
2016/0054670 A1* 2/2016 Urabe ..... G03G 9/0823 430/105

FOREIGN PATENT DOCUMENTS

JP 2012-208142 A 10/2012
JP 2013-057906 A 3/2013

OTHER PUBLICATIONS

Aug. 1, 2017 Office Action issued in Japanese Patent Application No. 2016-065798.
Oct. 17, 2017 Office Action issued in Japanese Application No. 2016-065798.

* cited by examiner

*Primary Examiner* — Janis L Dote
(74) *Attorney, Agent, or Firm* — Oliff PLC

(57) ABSTRACT

An electrostatic charge image developer includes a toner that includes a toner particle; and a carrier, wherein the toner particle contains a brilliant pigment, an exposed amount of the brilliant pigment contained in the toner particle is from 0.5% to 5%, the carrier has a core particle and a coating layer which covers a surface of the core particle, the coating layer contains a silicone resin and a siloxane oligomer, and a content of the siloxane oligomer is from 0.1 ppm to 500 ppm with respect to a total weight of the coating layer.

11 Claims, 1 Drawing Sheet

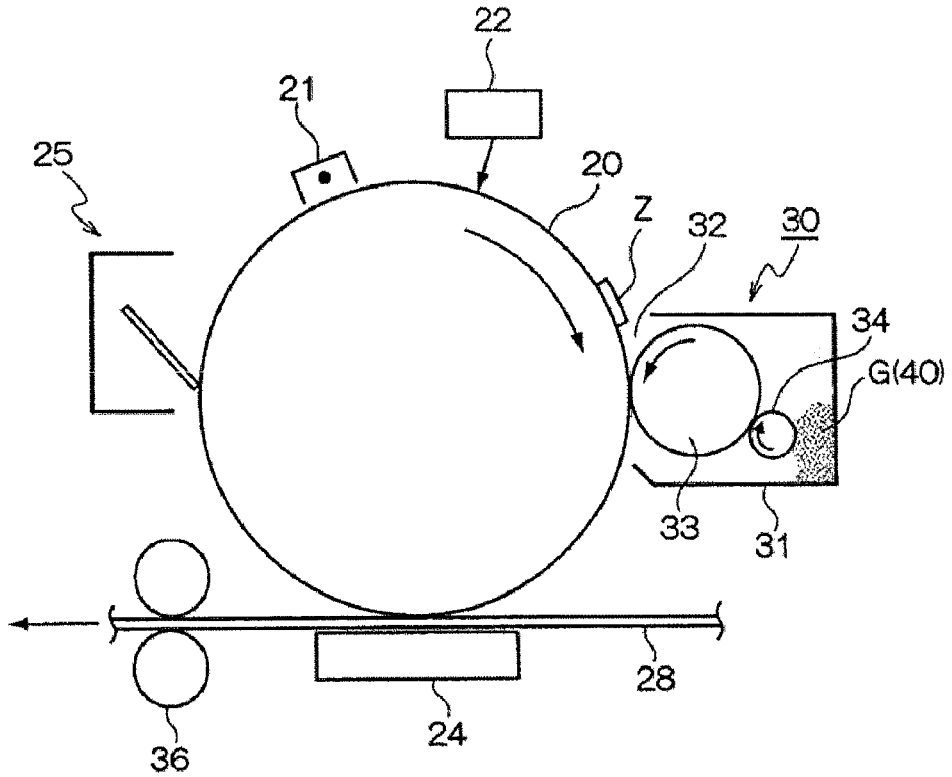
22
21
25
20
Z
32
30
34
G(40)
33
31
28
24
36

ELECTROSTATIC CHARGE IMAGE DEVELOPER, DEVELOPER CARTRIDGE, AND PROCESS CARTRIDGE

CROSS-REFERENCE TO RELATED APPLICATIONS

This application is based on and claims priority under 35 USC 119 from Japanese Patent Application No. 2016-065798 filed Mar. 29, 2016.

BACKGROUND

1. Technical Field

The present invention relates to an electrostatic charge image developer, a developer cartridge, and a process cartridge.

2. Related Art

A method of visualizing image information through an electrostatic charge image, such as electrophotography, has been currently used in various fields.

In the electrophotography in the related art, a method of visualizing image information through plural steps of forming an electrostatic latent image on a photoreceptor or an image holding member such as an electrostatic recording member using various units, developing the electrostatic latent image (toner image) by making voltage detecting particles called toner adhere to the electrostatic latent image, transferring the image to a surface of a transfer medium, and fixing the image to the transfer medium by heating or the like, has been generally used.

Among toners, for the purpose of forming an image having brilliance similar to metallic luster, a brilliant toner has been used.

SUMMARY

According to an aspect of the invention, there is provided an electrostatic charge image developer including:

a toner that include a toner particle; and a carrier, wherein the toner particle contains a brilliant pigment, an exposed amount of the brilliant pigment contained in the toner particle is from 0.5% to 5%, the carrier has a core particle and a coating layer which covers a surface of the core particle, the coating layer contains a silicone resin and a siloxane oligomer, and a content of the siloxane oligomer is from 0.1 ppm to 500 ppm with respect to a total weight of the coating layer.

BRIEF DESCRIPTION OF THE DRAWINGS

Exemplary embodiments of the present invention will be described in detail based on the following FIGURES, wherein:

The FIGURE is a configuration diagram showing an example of an image forming apparatus according to an exemplary embodiment including a developing device to which an electrostatic charge image developer according to an exemplary embodiment is applied.

DETAILED DESCRIPTION

Hereinafter, exemplary embodiments will be described.

In the exemplary embodiments, the expression "A to B" include not only a range between A to B but also a range including A and B, which are both ends thereof. For example, when "A to B" is a numerical range, the "A to B" represents "from A to B" or "from B to A".

In addition, in the exemplary embodiments, the terms "% by mass" and "% by weight" have the same meaning and "parts by mass" and the "parts by weight" have the same meaning.

In the present specification, the term "(meth)acrylate" means both "methacrylate" and "acrylate" and "(meth) acrylic acid" means both "methacrylic acid" and "acrylic acid".

Electrostatic Charge Image Developer

An electrostatic charge image developer of an exemplary embodiment (hereinafter, also simply referred to as "developer") includes a toner and a carrier. The toner contains toner particles, the toner particles contains a brilliant pigment, an exposed amount of the brilliant pigment contained in the toner is 0.5% to 5%, the carrier has a core particle and a coating layer which covers a surface of the core particle, the coating layer contains a silicone resin and a siloxane oligomer, and a content of the siloxane oligomer is 0.1 ppm to 500 ppm with respect to the total weight of the coating layer.

In the exemplary embodiment, the term "brilliance" refers to brilliance such as metallic luster which is exhibited when an image formed using the toner is visually recognized.

The term "brilliance such as metallic luster" means that a ratio (A/B) between a reflectance A at a light receiving angle of +30° that is measured when a solid image is formed using the toner and the image is irradiated with incident light at an incident angle of −45° using a goniophotometer and a reflectance B at a light receiving angle of −30° is from 2 to 100. When the ratio is within the above range, metallic luster may be observed at a wide viewing angle and a color image may be prevented from exhibiting a dull color. The "solid image" refers to an image with a coverage rate of 100%.

Toner

The toner used for the electrostatic charge image developer of the exemplary embodiment contains toner particles, and the toner particles contain a brilliant pigment. The exposed amount of the brilliant pigment contained in the toner is 0.5% to 5%.

Toner Particles

Number-Average Maximum Thickness C and Number-Average Equivalent Circle Diameter D The toner used for the electrostatic charge image developer of the exemplary embodiment contains toner particles.

In the toner particles, a ratio (C/D) between a number-average maximum thickness C and a number-average equivalent circle diameter D is preferably 0.1 or more and less than 0.7, more preferably 0.2 or more and less than 0.6, and still more preferably 0.3 or more and less than 0.5, from the viewpoint of prevention of formation of deletion and brilliance in the case operation is carried out in a high temperature and high humidity environment after operation in a high temperature and low humidity environment.

In addition, in the toner particles, from the viewpoint of stability of image density, the ratio (C/D) between the number-average maximum thickness C and the number-average equivalent circle diameter D of the toner particles is preferably from 0.7 to 1.2, more preferably from 0.8 to 1.1, and still more preferably from 0.8 to 1.0.

Measurement of Number-Average Maximum Thickness C and Number-Average Equivalent Circle Diameter D The number-average maximum thickness C and the number-average equivalent circle diameter D is measured by the following manner.

The toner is placed on a smooth surface and evenly dispersed by applying vibrations. 100 toner particles are observed with a color laser microscope "VK-9700" (manufactured by Keyence Corporation) at a magnification of 1,000 times to measure a maximum thickness C and an equivalent circle diameter D calculated from the projection area of a surface viewed from the top, and the arithmetic averages thereof are calculated to determine the number-average maximum thickness C and the average equivalent circle diameter D.

The equivalent circle diameter D is given as the following equation, when the projection area in a flake surface of which projection area is the maximum is X.

$$D=2\times(X/\pi)^{1/2}$$

Ratio (A/B) between Reflectance A at Light Receiving Angle of +30° and Reflectance H at Light Receiving Angle of −30°

In the toner used in the exemplary embodiment, a ratio (A/B) between a reflectance A at a light receiving angle of +30° that is measured when a solid image is formed using the toner and the image is irradiated with incident light at an incident angle of −45° using a goniophotometer and a reflectance B at a light receiving angle of −30° is from 2 to 100, preferably from 4 to 100, and more preferably from 4 to 50.

Measurement of Ratio (A/B) Using Goniophotometer

Here, first, the incident angle and the light receiving angle will be described. In the exemplary embodiment, when the measurement is performed using a goniophotometer, the incident angle is set to −45°. This is because the sensitivity of the measurement is high with respect to images of a wide range of brilliance.

In addition, the reason why the light receiving angle is set to −30° and +30° is that the sensitivity of the measurement is the highest for evaluating images having and not having the impression of brilliance.

Next, the method of measuring the ratio (A/B) will be described.

In the exemplary embodiment, when the ratio (A/B) is measured, first, a "solid image" is formed in the following manner. The "solid image" refers to an image with a coverage rate of 100%.

By using a goniospectrocolorimeter GC5000L manufactured by NIPPON DENSHOKU INDUSTRIES CO., LTD. as a goniophotometer, incident light that enters the solid image at an incident angle of −45° enters the image portion of the formed solid image, and the reflectance A at a light receiving angle of +30° and the reflectance B at a light receiving angle of −30° are measured. The reflectances A and B are measured with respect to light having a wavelength ranging from 400 nm to 700 nm at an interval of 20 nm, and the average value of the reflectance at each wavelength is calculated. The ratio (A/B) is calculated from the measurement results.

Brilliant Pigment

It is preferable that the toner particles of toner include a brilliant pigment.

As the brilliant pigment, a metal pigment may be used.

Examples of the metal pigment include powders of metals such as aluminum, brass, bronze, nickel, stainless steel, zinc, copper, silver, gold, and platinum, metal-deposited flaky glass powder. Among these metallic pigments, particularly, from the viewpoint of ease of availability and easily making toner particles into a flake shape, aluminum is most preferable. The surface of the metallic pigment may be coated with silica particles, an acrylic resin, a polyester resin and the like.

The brilliant pigment preferably has a flaky shape (planar shape) or a flake shape and more preferably has a flaky shape. In the brilliant pigment, the average equivalent circle diameter of the brilliant pigment is preferably longer than the average maximum thickness thereof. A spherical shape may be used.

A flaky particle is a particle having a substantially flat plane (X-Y plane) and having a substantially uniform thickness (Z). Here, the long diameter in a plan view of the flaky particle is defined as X, the short diameter thereof is defined as Y, and the thickness thereof is defined as Z. The X-Y plane is a plane giving the maximum projection area.

The circle-equivalent diameter means the diameter of a circle when the substantially flat surface (X-Y plane) of the brilliant pigment is assumed as a circle having the same projection area as the projection area of the brilliant pigment. In the case in which the substantially flat surface (X-Y plane) of the brilliant pigment is polygonal, the diameter of the circle obtained by converting the projection surface of the polygon into a circle is defined as the circle-equivalent diameter of the brilliant pigment. The average equivalent circle diameter of the brilliant pigment refers to an arithmetic average of the circle-equivalent diameters.

In addition, the average number of brilliant pigments included in the toner is not particularly limited and is preferably 1 to 5 and more preferably 1 to 3.

The brilliant pigment may be used alone or in combination with two or more kinds thereof.

The content of the brilliant pigment in the toner is preferably from 1 part by weight to 70 parts by weight and more preferably from 5 parts by weight to 50 parts by weight with respect to 100 parts by weight of the total weight of the toner.

Binder Resin

The toner particle of the exemplary embodiment contains a binder resin.

Examples of the binder resins include a homopolymer prepared by monomers such as styrenes (for example, styrene, p-chlorostyrene, α-methyl styrene, or the like), (meth) acrylic esters (for example, methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, 2-ethylhexyl methacrylate, or the like), ethylenic unsaturated nitriles (for example, acrylonitrile, methacrylonitrile, or the like), vinyl ethers (for example, vinyl methyl ether, vinyl isobutyl ether, or the like), vinyl ketones (for example, vinyl methyl ketone, vinyl ethyl ketone, vinyl isopropenyl ketone, or the like), olefins (for example, ethylene, propylene, butadiene, or the like), or a vinyl resin formed of a copolymer obtained by combining two or more kinds of these monomers.

Examples of the binder resin include a non-vinyl resin such as an epoxy resin, a polyester resin, a polyurethane resin, a polyamide resin, a cellulose resin, a polyether resin, and a modified rosin, a mixture of these and a vinyl resin, or a graft polymer obtained by polymerizing a vinyl monomer in the presence thereof.

These binder resins may be used alone or in combination with two or more kinds thereof.

As the binder resin, a polyester resin is preferable.

As the polyester resin, a known polyester resin is used, for example.

Examples of the polyester resin include polycondensates of polyvalent carboxylic acids and polyols. A commercially available product or a synthesized product may be used as the polyester resin.

Examples of the polyvalent carboxylic acid include aliphatic dicarboxylic acids (for example, oxalic acid, malonic acid, maleic acid, fumaric acid, citraconic acid, itaconic acid, glutaconic acid, succinic acid, alkenyl succinic acid, adipic acid, and sebacic acid), alicyclic dicarboxylic acids (for example, cyclohexanedicarboxylic acid), aromatic dicarboxylic acids (for example, terephthalic acid, isophthalic acid, phthalic acid, and naphthalenedicarboxylic acid), anhydrides thereof, or lower alkyl esters (having, for example, from 1 to 5 carbon atoms) thereof. Among these, for example, aromatic dicarboxylic acids are preferably used as the polyvalent carboxylic acid.

As the polyvalent carboxylic acid, a tri- or higher-valent carboxylic acid employing a crosslinked structure or a branched structure may be used in combination together with a dicarboxylic acid. Examples of the tri- or higher-valent carboxylic acid include trimellitic acid, pyromellitic acid, anhydrides thereof, or lower alkyl esters (having, for example, from 1 to 5 carbon atoms) thereof.

The polyvalent carboxylic acids may be used alone or in combination of two or more kinds thereof.

Examples of the polyol include aliphatic diols (for example, ethylene glycol, diethylene glycol, triethylene glycol, propylene glycol, butanediol, hexanediol, and neopentyl glycol), alicyclic diols (for example, cyclohexanediol, cyclohexanedimethanol, and hydrogenated bisphenol A), and aromatic diols (for example, ethylene oxide adduct of bisphenol A and propylene oxide adduct of bisphenol A). Among these, for example, aromatic diols and alicyclic diols are preferably used, and aromatic diols are more preferably used as the polyol.

As the polyol, a tri- or higher-valent polyol employing a crosslinked structure or a branched structure may be used in combination together with a diol. Examples of the tri- or higher-valent polyol include glycerin, trimethylolpropane, and pentaerythritol.

The polyols may be used alone or in combination of two or more kinds thereof.

The glass transition temperature (Tg) of the amorphous polyester resin is preferably from 50° C. to 80° C., and more preferably from 50° C. to 65° C.

The glass transition temperature is determined by a DSC curve obtained by differential scanning calorimetry (DSC), and more specifically, is determined by "Extrapolated Starting Temperature of Glass Transition" disclosed in a method of determining a glass transition temperature of JIS K7121-1987 "Testing Methods for Transition Temperature of Plastics".

The weight-average molecular weight (Mw) of the amorphous polyester resin is preferably from 5,000 to 1,000,000, and more preferably from 7,000 to 500,000.

The number-average molecular weight (Mn) of the amorphous polyester resin is preferably from 2,000 to 100,000.

The molecular weight distribution Mw/Mn of the amorphous polyester resin is preferably from 1.5 to 100, and more preferably from 2 to 60.

The weight-average molecular weight and the number-average molecular weight are measured by gel permeation chromatography (GPC). The molecular weight measurement by GPC is performed with a THF solvent using GPC•HLC-8120 GPC manufactured by Tosoh Corporation as a measurement device by using a column TSKgel SUPER HM-M (15 cm) manufactured by Tosoh Corporation. The weight-average molecular weight and the number-average molecular weight are calculated using a calibration curve of molecular weight created with a monodisperse polystyrene standard sample from results of this measurement.

A known preparing method is applied to prepare the amorphous polyester resin. Specific examples thereof include a method of conducting a reaction at a polymerization temperature set to 180° C. to 230° C., if necessary, under reduced pressure in the reaction system, while removing water or an alcohol generated during condensation.

When monomers of the raw materials are not dissolved or compatibilized under a reaction temperature, a high-boiling-point solvent may be added as a solubilizing agent to dissolve the monomers. In this case, a polycondensation reaction is conducted while distilling away the solubilizing agent. When a monomer having poor compatibility is present in a copolymerization reaction, the monomer having poor compatibility and an acid or an alcohol to be polycondensed with the monomer may be previously condensed and then polycondensed with the major component.

The total content of the binder resin is preferably from 40% by weight to 95% by weight, more preferably from 50% by weight to 90% by weight, and even more preferably from 60% by weight to 85% by weight with respect to the total weight of the toner particles.

Release Agent

The toner particles preferably contain a release agent.

Examples of the release agent include hydrocarbon waxes; natural waxes such as carnauba wax, rice wax, and candelilla wax; synthetic or mineral/petroleum waxes such as montan wax; and ester waxes such as fatty acid esters and montanic acid esters. The release agent is not limited thereto.

Specific preferable examples of the release agent are ester wax, polyethylene, polypropylene, or polyethylene-polypropylene copolymers, but include unsaturated fatty acids such as polyglycerin wax, microcrystalline wax, paraffin wax, carnauba wax, sasol wax, montanic acid ester wax, deoxidized carnauba wax, palmitic acid, stearic acid, montanic acid, brassidic acid, eleostearic acid, and parinaric acid; saturated alcohols such as stearyl alcohol, aralkyl alcohol, behenyl alcohol, carnaubyl alcohol, ceryl alcohol, melissyl alcohol, and long-chain alkyl alcohols having longer-chain alkyl groups; polyols such as sorbitol; fatty acid amides such as linoleic acid amide, oleic acid amide, and lauric acid amide; saturated fatty acid bis-amides such as methylene-bis-stearic acid amide, ethylene-bis-capric acid amide, ethylene-bis-lauric acid amide, and hexamethylene-bis-stearic acid amide; unsaturated fatty acid amides such as ethylene-bis-oleic acid amide, hexamethylene-bis-oleic acid amide, N,N'-dioleyladipic acid amide, and N,N'-dioleylsebacic acid amide; aromatic bis-amides such as m-xylene-bis-stearic acid amide and N,N'-distearylisophthalic acid amide; fatty acid metal salts (generally called metallic soap) such as calcium stearate, calcium laurate, zinc stearate, and magnesium stearate; grafted waxes obtained by grafting aliphatic hydrocarbon waxes with vinyl monomers such as styrene and acrylic acid; partially esterified compounds between a fatty acid and a polyol such as behenic acid monoglyceride; and methyl ester compounds having a hydroxyl group and obtained by hydrogenating vegetable fat and oil.

The release agents may be used alone or in combination of two or more kinds thereof.

The content of the release agent is preferably in a range of 1 part by weight to 20 parts by weight and more preferably in a range of 3 parts by weight to 15 parts by weight with respect to 100 parts by weight of the binder resin. When the content of the release agent is in the above range, satisfactory fixing and image properties may be attained.

Other Coloring Agents

The toner particles may contain coloring agents other than the brilliant pigment, if necessary.

As other coloring agents, known coloring agents may be used. From the viewpoint of hue angle, chroma, luminosity, weather resistance, OHP transparency, and dispersiveness in the toner, the coloring agent may be optionally selected.

Specific examples thereof include various pigments such as watch young red, permanent red, brilliant carmin 3B, brilliant carmin 6B, Du Pont oil red, pyrazolone red, lithol red, Rhodamine B Lake, Lake Red C, and rose bengal, and various coloring agents such as acridine coloring agents, xanthene coloring agents, azo coloring agents, benzoquinone coloring agents, azine coloring agents, anthraquinone coloring agents, thioindigo coloring agents, dioxadine coloring agents, thiazine coloring agents, azomethine coloring agents, indigo coloring agents, thioindigo coloring agents, phthalocyanine coloring agents, aniline black coloring agents, polymethine coloring agents, triphenylmethane coloring agents, diphenylmethane coloring agents, thiazine coloring agents, thiazole coloring agents, and xanthene coloring agents.

As specific examples of other coloring agents, carbon black, nigrosine dye (C.I. No. 50415B), aniline blue (C.I. No. 50405), calco oil blue (C.I. No. azoic Blue 3), chromium yellow (C.I. No. 14090), ultramarine blue (C.I. No. 77103), Du Pont oil red (C.I. No. 26105), quinoline yellow (C.I. No. 47005), methyl blue chloride (C.I. No. 52015), phthalocyanine blue (C. I. No. 74160), malachite green oxalate (C.I. No. 42000), lamp black (C.I. No. 77266), Rose Bengal (C.I. No. 45435), and mixtures thereof may be used.

The amount of other coloring agents used is preferably 0.1 parts by weight to 20 parts by weight and more preferably 0.5 parts by weight to 10 parts by weight with respect to 100 parts by weight of the toner particles. In addition, as the coloring agent, these pigments and dyes may be used alone or in combination of two or more kinds thereof.

As a method of dispersing other coloring agents, an arbitrary method, for example, a common dispersing method using, for example, a rotary shearing-type homogenizer, or a ball mill, a sand mill, or a Dyno mill having media may be used and there is no limitation thereto. In addition, the coloring gent particles of these agents may be added to a mixed solvent with other particle components at one time or in parts at multiple stages.

External Additive

It is preferable that the toner contains an external additive.

Examples of the external additive include inorganic particles and organic particles, and inorganic particles are preferable.

Examples of the inorganic particles include silica, alumina, titanium oxide, metatitanic acid, barium titanate, magnesium titanate, calcium titanate, strontium titanate, zinc oxide, silica sand, clay, mica, wollastonite, diatomite, cerium chloride, red oxide, chromium oxide, cerium oxide, antimony trioxide, magnesium oxide, zirconium oxide, silicon carbide, and silicon nitride.

Among these, titanium oxide particles and/or silica particles are preferably contained in the toner.

The surfaces of the inorganic particles are preferably treated with a hydrophobizing agent in advance.

The treatment with a hydrophobizing agent may be carried out by dipping the inorganic particles in a hydrophobizing agent.

The hydrophobizing agent is not particularly limited and examples thereof include a silane coupling agent, a silicone oil, a titanate coupling agent, and an aluminum coupling agent. These agents may be used singly or in combination of two or more kinds thereof. Among these, a silane coupling agent may be suitably used.

Organic particles are generally used for the purpose of improving cleaning performance and transferability, and specific examples thereof include powders of fluorine resins such as polyvinylidene fluoride, and polytetrafluoroethylene, polystyrene, and polymethyl methacrylate.

The number-average particle diameter of the external additive is preferably 1 nm to 300 nm, more preferably 10 nm to 200 nm, and still more preferably 15 nm to 180 nm.

In addition, the external additives may be used singly or in combination of two or more kinds thereof.

The ratio of the external additive in the toner is preferably 0.01 parts by weight to 5 parts by weight and more preferably 0.1 parts by weight to 3.5 parts by weight with respect to 100 parts by weight of the toner particles.

Other Components

If necessary, various components such as an internal additive, a charge-controlling agent, an inorganic powder (inorganic particles), and organic particles, in addition to the above-described components, may be added the toner.

Examples of the internal additive include magnetic substances of metals and alloys, such as ferrite, magnetite, reduced iron, cobalt, nickel, and manganese, and compounds including these metals. When the toner is used as a magnetic toner by incorporating the magnetic substances, the average particle diameter of the ferromagnetic thereof is preferably 2 μm or less and more preferably about 0.1 μm to 0.5 μm. The amount of the magnetic substance contained in the toner is preferably 20 parts by weight to 200 parts by weight with respect to 100 parts by weight of the resin component and is particularly preferably 40 parts by weight to 150 parts by weight with respect to 100 parts by weight of the resin component. In addition, it is preferable that as magnetic properties under application of 10K oersteds, a coercive force (Hc) is 20 oersteds to 300 oersteds, a saturation magnetization ($\sigma s$) is 50 emu/g to 200 emu/g, and a residual magnetization ($\sigma r$) is 2 emu/g to 20 emu/g.

Examples of the charge-controlling agent include fluorine surfactants, metal containing dyes, such as salicylic acid metal complexes and azo metal compounds, polymeric acids, such as copolymers containing a maleic acid as the monomer unit, quaternary ammonium salts, and azine dyes, such as nigrosine.

The toner may include an inorganic powder for the purpose of adjusting a viscoelasticity. Examples of the inorganic powder include all of inorganic particles, such as silica, alumina, titanium oxide, calcium carbonate, magnesium carbonate, calcium phosphate, and cerium oxide, which are typically used as external additives on the toner surface, as described in detail below.

Embodiment and Physical Properties of Toner

Number-Average Particle Diameter

The number-average particle diameter of the toner is from 2 μm to 20 μm, more preferably from 2.5 μm to 15 μm, and still more preferably from 3 μm to 12 μm. When the number-average particle diameter of the toner is within the above range, fluidity is excellent and high resolution image may be obtained.

The average particle diameter of the particles of toner, toner particles, and the like is suitably measured using a COULTER MULTISIZER II (manufactured by Beckman Coulter Inc.). In this case, the average particle diameter is measured using the optimum aperture according to the particle diameter level of the particles. A cumulative volume distribution curve and a cumulative number distribution curve are drawn from the smaller particle diameter side, respectively, for each particle diameter range (channel) divided based on a particle diameter distribution. The particle diameter providing 50% accumulation is defined as that corresponding to volume $D_{50v}$ and number $D_{50p}$ The volume-average particle diameter is calculated as $D_{50v}$ and the number-average particle diameter is calculated as $D_{50p}$.

The average particle diameter of the particles of toner and the like may be measured using a COULTER MULTISIZER II (manufactured by Beckman Coulter Inc.). In this case, the average particle diameter may be measured using the optimum aperture according to the particle diameter level of the particles. The measured particle diameter of the particles is expressed as a number-average particle diameter.

In the case in which the particle diameter of the particles is about 5 μm or less, the particle diameter may be measured by using a laser diffraction/scattering particle size distribution measuring device (for example, LA-700, manufactured by Horiba, Ltd.).

Further, in the case in which the particle diameter has nanometer-order, the particle diameter is measured by a BET specific surface area measuring device (FLOW SORBII2300, manufactured by Shimadzu Corporation).

Exposed Amount of Brilliant Pigment

The exposed amount of the brilliant pigment in the toner used in the exemplary embodiment is preferably 0.5% to 5%, more preferably 0.8% to 4.5%, and still more preferably 1% to 4%.

When the amount of the brilliant pigment exposed is within the above range, an electrostatic charge image developer, capable of preventing deletion and color spots from being formed and exhibiting excellent stability in image density even in the case of carrying out operation in a high temperature and high humidity environment after operation in a high temperature and low humidity environment, and preventing initial fogging after being kept to stand from occurring, may be obtained.

The amount of the brilliant pigment exposed in the toner may be measured by detecting a brilliant pigment component on the surface of the toner using an X-ray photoelectron spectroscopy (XPS). For example, in the case in which the brilliant pigment is an aluminum pigment, the exposed amount of the brilliant pigment may be measured by measuring the rate of the peak derived from Al element.

As the X-ray photoelectron spectrophotometer, for example, JPS-9000MX (manufactured by JEOL Ltd.) may be used.

Preparing Method of Toner

The toner used in the exemplary embodiment is prepared by a known method such as a wet method or a dry method and is preferably prepared by a wet method.

The toner used in the exemplary embodiment is prepared, for example, in the following manner.

A binder resin, a release agent, a brilliant pigment, a charge-controlling agent, and a polymerization initiator are mixed with a polymerizable monomer.

The polymerizable monomer is not particularly limited as long as the monomer constitutes the binder resin through polymerization. The polymerizable monomer is preferably a radical polymerizable compound and more preferably an ethylenically unsaturated compound.

As the polymerizable monomer, monomers described in the description of the binder resin are preferable and styrene compounds (for example, styrene, para-chlorostyrene, α-methyl styrene, or the like), and (meth)acrylic esters (for example, methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, 2-ethylhexyl methacrylate, or the like) are more preferably mentioned as examples.

The polymerization initiator is not particularly limited and known polymerization initiators may be used. However, a radical polymerization initiator is preferable.

In the toner used in the exemplary embodiment, when the toner materials are incorporated, that is, when the raw materials are mixed, the content of the polyester resin is preferably 51% by weight to 90% by weight with respect to the total weight of the resin component included in the toner materials.

Here, the resin component includes a resin appropriately added for the purpose of improving properties of the toner or the like, in addition to the above-described polymerizable monomer and binder resin, and the total weight of the resin component refers to a total amount of the amounts of the respective resin components.

As the method of incorporating the polymer resin in an amount of 51% by weight or more with respect to the total weight of the resin component when the toner materials are incorporated, there are methods of 1) dissolving the above toner materials in a solvent;

2) using a low molecular weight polyester resin in a suspension polymerization method instead of using a polyester resin used in the related art;

3) combining 1) and 2); and 4) making resin particles adhere to surfaces of solid (undissolved) polyester particles and incorporating the polyester particles into suspended particles formed of a polymerizable monomer through the resin fine particles.

In addition, the method is not limited to combining 1) and 2) above and 1), 2), and 4) may be appropriately combined.

The content of the polyester resin is preferably 51 parts by weight to 90 parts by weight and more preferably 60 parts by weight to 90 parts by weight with respect to the total weight of the resin component and the resin properties of the polyester resin, such as low temperature fixability and low energy consumption fixability, may be reliably exhibited.

Next, the mixture obtained as described above is uniformly dissolved or dispersed by a disperser such as a homogenizer or an ultrasonic disperser to obtain a monomer system. This monomer system is dispersed in a water medium including a dispersion stabilizer using a stirrer, a homomixer, a homogenizer, or the like after stirring.

In the suspension polymerization method, 300 parts by weight to 3,000 parts by weight of water with respect to 100 parts by weight of the monomer system is preferably used as a dispersion medium.

In this case, it is preferable that the liquid droplets of the monomer in the water medium are granulated so as to have a desired toner particle size by adjusting the stirring speed and the stirring time. The particle diameter of the liquid droplet in this case is generally 10 μm or less.

Thereafter, the particle state is maintained due to the action of the dispersion stabilizer and stirring is carried out to an extent that the particles are prevented from being precipitated. The polymerization temperature is set to a temperature of 40° C. or higher, generally, a temperature of from 50° C. to 90° C. In addition, the temperature may be increased in the latter half of the polymerization reaction. Further, after the polymerization reaction, or after the completion of the reaction, some of the water medium may be removed. Thus, it is possible to remove an unreacted polymerizable monomer or a by-product, which is a cause of smell generated when the toner is fixed.

After the completion of the reaction, the produced toner particles are separated from the water medium and repeatedly washed and filtered to collect final toner particles. After the toner particles are dried, the toner particles are mixed with an external additive such as inorganic particles or the like and the external additive is made to adhere to the surfaces of the toner particles.

The exposed amount of the brilliant pigment may be adjusted by adjusting the dripping speed, the stirring speed, and the temperature at the time of stirring when the monomer system is dispersed.

In addition, the amount of the brilliant pigment exposed may be adjusted by adjusting the dripping speed, the stirring speed, and the temperature at the time of stirring when the monomer system is dispersed, and adjusting the conditions when the toner particles are dispersed from a different wet medium.

The preparing method of the toner used in the exemplary embodiment is not limited to the above-described method and the toner may be prepared by appropriately changing the preparation steps.

It is preferable that the solvent used in the above 1) is a volatile organic solvent having a boiling point of lower than 100° C. from the viewpoint of easy removal after toner particles are formed. Specifically, toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, methylisobutylketone, and the like may be used singly or in combination of two or more kinds thereof. Particularly, aromatic solvents such as toluene and xylene, ethyl acetate, and the like are preferable.

The amount of the solvent used is typically 0 parts by weight to 300 parts by weight, preferably 0 parts by weight to 100 parts by weight, and more preferably 25 parts by weight to 70 parts by weight with respect to 100 parts by weight of the polymerizable monomer.

In addition, among the methods described in above 1) to 4), 4) is a method of application of the method used in the stretching method of the related art, and is a method of making the phase of the polyester to a solid phase (unsolved state), incorporating the solid polyester to adhere into a solution of a polymerizable monomer (hereinafter, also referred to as "monomer") in a state in which organic resin fine particles (organic micro-polymer substrate; hereinafter, also referred to as OMS) adhere to the surface, and then conducting suspension polymerization by a known method.

Specifically, a polyester resin powder, which becomes a nucleus, is put into the water solution in which the organic resin fine particles are dispersed, the materials are stirred, and organic resin fine particles (OMS) is made to adhere to the surfaces of the polyester resin particles. Next, a separately prepared toner liquid material is poured into the dispersion including the organic resin fine particles (OMS) to prepare a suspension. The toner liquid material includes at least a polymerizable monomer and a brilliant pigment, and a resin may be further appropriately added to the toner liquid material in order to improve the properties of the toner. The polyester nucleus particles in the suspension are trapped in suspended particles formed of the monomer included in the suspension through the organic resin fine particles (OMS). Then, suspension polymerization is typically carried out by a known method, and suspended polymerizable particles which trap plural polyester particles therein, that is, toner particles, are formed.

Among the above 1), 2) and 4), since a solvent is used in the method of 1), a solvent removal step is additionally required compared to the suspension polymerization method of the related art.

In addition, adopting the method of 2), that is, a method of reducing the molecular weight of the polyester resin to be used makes it possible to increase the amount of polyester dissolved. However, there is an influence on the storage stability and fixability of the toner and thus the amount thereof is required to be adjusted within a range in which these properties and an increase in the dissolved amount are attained.

In comparison with these, adopting the method shown in 4), that is, a method of, instead of using the polyester resin to be contained in the toner liquid material in advance, or together with the polyester resin, using a solid polyester resin nucleus as a combinedly used resin makes it possible to more easily and reliably trap the polyester resin in the suspended particles. Thus, this method is preferable.

As the organic resin, any organic resin may be used as long as the organic resin may form an aqueous dispersion. The organic resin may be a thermoplastic resin or a thermosetting resin. Examples thereof include vinyl resin, polyurethane resin, epoxy resin, polyester resin, polyamide resin, polyimide resin, silicon resin, phenolic resin, melamine resin, urea resin, aniline resin, ionomer resin, and polycarbonate resin. As the resin, two or more kinds of the above resins may be used in combination.

Among these, from the viewpoint of easily obtaining an aqueous dispersion of spherical resin fine particles, vinyl resin, polyurethane resin, epoxy resin, polyester resin, and a combination thereof are preferably used. For example, the vinyl resin is a polymer obtained by homopolymerizing or copolymerizing a vinyl monomer, and examples thereof include resins such as a styrene-(meth)acrylate copolymer, a styrene-butadiene copolymer, a (meth)acrylic acid-acrylate copolymer, a styrene-acrylonitrile copolymer, a styrene-maleic anhydride copolymer, and a styrene-(meth)acrylic acid copolymer. The average particle diameter of the resin particles is 5 nm to 200 nm and preferably 20 nm to 300 nm.

Examples include methyl polymethacrylate fine particles of 1 μm and 3 μm, polystyrene fine particles of 0.5 and 2 μm, and poly(styrene-acrylonitrile) fine particles of 1 μm; and trade name include PB-200H (manufactured by Kao Corporation), SGP (manufactured by Soken Chemical & Engineering Co., Ltd.), TECHNOPOLYMER SB (manufactured by Sekisui Plastics), SGP-3G (manufactured by Soken Chemical & Engineering Co., Ltd.), and MICROPEARL (manufactured by SEKISUI CHEMICAL CO., LTD.).

As a dispersant that may be used with the above resin fine particles, a polymer protective colloid may be used. The dispersion liquid droplets may be stabilized by adding the polymer protective colloid. For example, acids such as acrylic acid, methacrylic acid, α-cyanoacrylic acid, α-cyanomethacrylic acid, itaconic acid, crotonic acid, fumaric acid, maleic acid, and maleic acid anhydride, or a (meth) acrylic monomer containing an acid group such as acrylic acid-β-hydroxyethyl, methacrylic acid-β-hydroxyethyl, acrylic acid-β-hydroxypropyl, methacrylic acid-β-hydroxypropyl, acrylic acid-γ-hydroxypropyl, methacrylic acid-γ-hydroxypropyl, acrylic acid-3-chloro-2-hydroxypropyl, methacrylic acid-3-chloro-2-hydroxypropyl, diethylene glycol monoacrylic acid ester, diethylene glycol monomethacrylic acid ester, glycerine monoacrylic acid ester, glycerine monomethacrylic acid ester, N-methylol acrylamide, or N-methylol methacrylamide, vinyl alcohol or esters of vinyl alcohol such as vinyl methyl ether, vinyl ethyl ether, and vinyl propyl ether, or esters of compounds containing a carboxyl group and vinyl alcohol such as vinyl acetate, vinyl propionate, and vinyl butylate, acrylamide, methacrylamide, diacetone acrylamide, or methylol compounds thereof, acid chlorides such as acrylic acid chloride, and methacrylic acid chloride, homopolyers or copolymers of nitrogen-containing compounds, such as vinylpyridine, polyvinyl pyrrolidone, polyvinyl imidazole, and ethyleneimine, or of these nitrogen-containing compounds each having a heterocyclic ring, polyoxyethylene compounds such as polyoxyethylene, polyoxypropylene, polyoxyethylene alkylamine, polyoxypropylene alkylamine, polyoxyethylene alkylamide, polyoxypropylene alkylamide, polyoxyethylene nonyl phenyl ether, polyoxyethylene lauryl phenyl ether, polyoxyethylene stearyl phenyl ester and polyoxyethylene nonyl phenyl ester, and celluloses such as methyl cellulose, hydroxyethyl cellulose and hydroxypropyl cellulose may be used.

The content of the organic resin fine particles in the water medium is preferably 1% by weight to 2% by weight with respect to the total weight of oil phases, that is, with respect to the total weight of the polymerizable monomer, the combindely used resin, the release agent, the brilliant pigment, the charge-controlling agent, the polymerization initiator, the polyester resin nucleus, and the organic resin fine particles in the exemplary embodiment.

As the method of externally adding an external additive to the surfaces of the toner particles is not particularly limited and a known method may be used. For example, a method of making an external additive adhere to the toner particles by a mechanical method or a chemical method may be used.

Carrier

The carrier used for the electrostatic charge image developer of the exemplary embodiment has a core particle and a coating layer that covers the surface of the core particle. The coating layer contains a silicone resin and a siloxane oligomer, and a content of the siloxane oligomer is 0.1 ppm to 500 ppm with respect to the total weight of the coating layer.

Core Particle

The material for constituting the core particle is preferably a magnetic material and examples thereof include magnetic metals such as iron, steel, nickel, and cobalt; alloys of these magnetic metals and manganese, chromium, rare earths, and the like; and magnetic oxides such as ferrite and magnetite.

The core particle may be obtained by magnetic granulation and sintering, and a magnetic material may be pulverized as a pre-treatment. A pulverizing method is not particularly limited, and specific examples thereof include known pulverizing methods such as a mortar, a ball mill, and a jet mill.

The volume-average particle diameter of the core particles is preferably from 10 μm to 500 μm, more preferably from 20 μm to 100 μm, and particularly preferably from 20 μm to 40 μm.

The volume-average particle diameter of the core particles is measured using a laser diffraction/scattering particle size distribution device.

The volume intrinsic resistance $R^1$ at 100 V and the volume intrinsic resistance $R^2$ at 500 V of the core particle preferably satisfy the following equation 1, more preferably satisfy the following equation 1-1, and still more preferably satisfy the following equation 1-2.

$$0.8 \leq R^2/R^1 \leq 1.0 \quad \text{Equation 1:}$$

$$0.85 \leq R^2/R^1 \leq 1.0 \quad \text{Equation 1-1:}$$

$$0.90 \leq R^2/R^1 \leq 1.0 \quad \text{Equation 1-2:}$$

Hereinafter, the above $R^2/R^1$ is also referred to as a volume intrinsic resistance ratio of the core particle.

The volume intrinsic resistance ratio of the core particle may be calculated from the volume intrinsic resistance measured in the following manner.

The volume resistivity of the core particle is measured as follows.

The toner and the carrier are separated from the developer in a developing device with an air blow to collect the carrier. The collected carrier is put into a solvent capable of dissolving the coating layer of the carrier and the coating layer is dissolved to remove the coating layer. Thus, cores are collected. The cores may be treated with the solvent capable of dissolving the coating layer plural times in order to remove the coating layer and may be treated with ultrasonic waves. Then, the solvent is dried to collect cores. Next, the collected cores are placed flat at a thickness of from 1 mm to 3 mm on a surface of a circular tool on which an electrode plate of 20 $cm^2$ is disposed, to form a layer. The same electrode plate of 20 $cm^2$ is placed thereon, holding the layer. In order to eliminate a gap between objects to be measured, a load of 4 kg is applied on the electrode plate disposed on the layer and, thereafter, a thickness (cm) of the carrier layer is measured. Both electrodes on and under the layer are connected to an electrometer and a high voltage source generating device. A voltage of 100V and 500V is applied to both electrodes and a current value (A) flown thereupon is read. The measurement is carried out in an environment of a temperature of 20° C. and a humidity of 50% RH. A calculation equation of the volume electric resistance (Ω·cm) of the object to be measured at 100 V or 500 V is as follow.

$$R = E \times 20/(I - I0)/L$$

In the equation, R represents a volume electric resistance (Ω·cm) of the object to be measured, E represents an application voltage (V), I represents a current value (A), I0 represents a current value (A) at an application voltage of 0 V, and L represents a thickness (cm) of the layer, respectively. In addition, a coefficient 20 represents an area ($cm^2$) of the electrode plate.

Coating Layer

The coating layer of the carrier includes a silicone resin, a siloxane oligomer, and if necessary, other additives such as conductive particles.

Silicone Resin

As the silicone resin, known silicone resins may be used and is not particularly limited as long as the silicone resin is a siloxane polymer having a Si—O—Si bond as a main chain, and an organic group such as a methyl group and a phenyl group as a side chain. A straight silicone resin having a main chain composed of —Si($R^1R^2$)—O— ($R^1$ and $R^2$ are each independently an alkyl or aryl group, and preferably a methyl group or a phenyl group) and not having a branched-chain, and a modified silicone resin obtained by modifying the straight silicone resin with alkyd, acryl, epoxy, or urethane are preferably used.

As the straight silicone resin, dimethylpolysiloxane or methylphenylpolysiloxane is preferable.

As the modified silicone resin, an alkyd modified silicone resin, an acrylic modified silicone resin, an epoxy modified silicone resin, and a urethane modified silicone resin are preferable and an acrylic modified silicone resin is more preferable.

The weight-average molecular weight of the silicone resin is 10,000 or more, preferably 15,000 or more, and more preferably 20,000 or more.

The upper limit of the weight-average molecular weight is not particularly limited and may be 300,000 or less, and preferably 200,000 or less.

As the straight silicone resin, commercially available products may be used and examples thereof include KR271, KR255, and KR152 manufactured by Shin-Etsu Chemical Co., Ltd; and SR2400, SR2406, and SR2410 manufactured by Dow Corning Toray Silicone Co., Ltd.

As the modified silicone resin, commercially available products may be used and examples thereof include KR206 (alkyd-modified), KR5208 (acrylic-modified), ES1001N (epoxy-modified), KR305 (urethane-modified) manufactured by Shin-Etsu Chemical Co., Ltd; and SR2115 (epoxy-modified), and SR2110 (alkyd-modified) manufactured by Dow Corning Toray Silicone Co., Ltd.

These silicone resins may be used singly or in combination of two or more kinds thereof.

The content of the silicone resin is preferably 50% by weight or more, more preferably 80% by weight or more, and still more preferably 90% by weight or more with respect to the total weight of the coating layer.

Siloxane Oligomer

As the siloxane oligomer, known siloxane oligomers may be used and the siloxane oligomer is not particularly limited as long as the siloxane oligomer is siloxane oligomer having a Si—O—Si bond as a main chain and an organic group as a side chain. However, it is preferable that the siloxane oligomer is a condensate of an alkoxysilane compound.

The alkoxysilane compound is not particularly limited as long as the alkoxysilane compound is a compound has an alkoxysilyl group. A silane coupling agent represented by the following formula S-1 is preferable used.

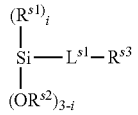

(S-1)

In the formula S-1, $R^{S1}$ each independently represents an alkyl group or aryl group, $R^{S2}$ each independently represents an alkyl group or aryl group, i represents an integer of 0 to 2, $L^{si}$ represents a single bond or an alkylene group, and $R^{s3}$ represents a functional group.

$R^{S1}$ is preferably an alkyl group having 1 to 20 carbon atoms or an aryl group having 6 to 18 carbon atoms.

The number of carbon atoms of the alkyl group is preferably 1 to 10, more preferably 1 to 5, and still more preferably 1 to 3. The number of carbon atoms of the aryl group is preferably 6 to 12 and more preferably 6.

$R^{S2}$ is preferably an alkyl group having 1 to 3 carbon atoms or a phenyl group, more preferably an alkyl group having 1 to 3 carbon atoms, and still more preferably a methyl group.

i represents an integer of 0 to 2 and is preferably 0 or 1.

In the case in which $L^{S1}$ is a divalent linking group, $L^{S1}$ is preferably a group formed by combining —$(CH_2)_{n1}$- or —$(CH_2)_{n1}$- and —O—. Here, n1 is preferably 1 to 10, more preferably 1 to 6, and still more preferably 1 to 3.

$R^{s3}$ is preferably at least one functional group selected from a vinyl group, an epoxy group, a (meth)acryloxy group, an amino group, a ureido group, a mercapto group, a sulfide group, and an isocyanate group, and more preferably an amino group.

Examples of the silane coupling agent include vinyl trimethoxysilane, γ-(meth)acryloxypropyl-tris(β-methoxyethoxy)silane, 3-methacryloxypropyl trimethoxysilane, 3-glycidoxypropyl trimethoxysilane, β-(3,4-epoxycyclohexyl)ethyl trimethoxysilane, γ-glycidoxypropyl trimethoxysilane, vinyl triacetoxysilane, γ-mercaptopropyl trimethoxysilane, γ-aminopropyl triethoxysilane, N-β-(aminoethyl)-γ-aminopropyl trimethoxysilane, N-β-(aminoethyl)-γ-aminopropylmethyl methoxysilane, N,N-bis(β-hydroxyethyl)-γ-aminopropyl triethoxysilane, and γ-chloropropyl trimethoxysilane. Among these, particularly preferable silane coupling agents include N-2-(aminoethyl)-3-aminopropyl trimethoxysilane, N-2-(aminoethyl)-3-aminopropylmethyl dimethoxysilane, 3-aminopropyl triethoxysilane, and N-phenyl-3-aminopropyl trimethoxysilane.

The siloxane oligomer is preferably a pentamer to 100-mer of the alkoxysilane compound, more preferably a pentamer to 50-mer, and still more preferably a pentamer to 30-mer.

In addition, the structure of the siloxane oligomer is may be linear, branched, or cyclic, or may be a mixture thereof.

The weight-average molecular weight of the siloxane oligomer is less than 10,000, preferably less than 5,000, and more preferably less than 3,000.

The lower limit of the weight-average molecular weight is not particularly limited and may be 300 or more and is preferably 500 or more.

The content of the siloxane oligomer is 0.1 ppm to 500 ppm, preferably 1 ppm to 450 ppm, and more preferably 5 ppm to 400 ppm with respect to the total weight of the coating layer.

When the content of the siloxane oligomer is within the above range, an electrostatic charge image developer capable of preventing deletion and color spots from being formed and exhibiting excellent density stability even in the case of carrying out operation in a high temperature and high humidity environment after operation in a high temperature and low humidity environment, and preventing initial fogging after being kept to stand may be obtained.

The content of the siloxane oligomer may be measured by rinsing out the developer and collecting the carrier, then carrying out soxlet extraction using tetrahydrofuran (THF) as a solvent, and carrying out liquid chromatography mass spectrometry (LCMS) measurement on the extract.

The measurement by LCMS may be carried out under the following conditions.

LC system: Waters 2695 Separations Module

LC eluent condition: acetonitrile/50 ml aqueous ammonium acetate solution (9/1)

Flow rate: 1 ml/min

Column temperature: 40° C.

MS system: Waters 2695 Q-micro

The ratio between an exposed amount of the brilliant pigment and an amount of the siloxane oligomer is preferably from 1:500 to 10:1.

Crosslinking Agent

The coating layer used in the exemplary embodiment may contain a crosslinking agent.

The crosslinking agent is a component for causing a crosslinking reaction and preferably a component for causing a crosslinking reaction by heat.

As the crosslinking agent, the above-described silane coupling agent may be used.

The content of the crosslinking agent is preferably 0.1% by weight to 10% by weight, more preferably 0.2% by weight to 8% by weight, and still more preferably 0.5% by weight to 5% by weight with respect to the total weight of the coating layer.

Conductive Powder

The coating layer used in the exemplary embodiment may contain a conductive powder.

Examples of the conductive powder include metal powder, carbon black, titanium oxide, tin oxide, and zinc oxide. The number-average particle diameter of these conductive powders is preferably 1 μm or less. When the number-average particle diameter is 1 μm or more, the control of electric resistance is easy.

The content of the conductive powder is preferably 0.1% by weight to 10% by weight, more preferably 0.2% by weight to 8% by weight, and still more preferably 0.5% by weight to 5% by weight with respect to the total weight of the coating layer.

Coating Resin

The coating layer used in the exemplary embodiment may contain a coating resin other than the silicone resin.

Examples of the coating resin include acrylic resin, polyethylene resin, polypropylene resin, polystyrene resin, polyacrylonitrile resin, polyvinyl acetate resin, polyvinyl alcohol resin, polyvinyl butyral resin, polyvinyl chloride resin, polyvinyl carbazole resin, polyvinyl ether resin, polyvinyl ketone resin, vinyl chloride-vinyl acetate copolymer, styrene-acrylic acid copolymer, fluororesin, polyester resin, polyurethane resin, polycarbonate resin, phenolic resin, amino resin, melamine resin, benzoguanamine resin, urea resin, amide resin, and epoxy resin.

The weight-average molecular weight of the coating resin is preferably from 5,000 to 1,000,000 and more preferably from 10,000 to 200,000.

The content of the coating resin sis preferably 0% by weight to 20% by weight, more preferably from 0% by weight to 10% by weight, and still more preferably 0% by weight to 5% by weight with respect to the total weight of the coating layer.

Coverage

The coverage of the coating layer is preferably 80% or more and more preferably 90% or more with respect to the surface of the core particle.

The coverage is expressed as a degree of coating of the coating resin with respect to the surface of the core particle, and is preferably 20% or less and more preferably 10% or less when an element (for example, iron) measured through element analysis of a uncovered portion in fluorescence X-ray measurement is irradiated with X rays in a wider range (for example, about ⅓ to ⅔ of a projection area of one carrier).

Physical Properties of Carrier

The volume-average particle diameter of the carrier is preferably from 10 μm to 500 μm, more preferably from 20 μm to 100 μm, and particularly preferably from 20 μm to 40 μm.

The volume-average particle diameter of the carrier is measured by a laser diffraction/scattering particle size distribution device.

The volume electric resistance (25° C.) of the carrier is preferably from $1\times10^{7}$ Ω·cm to $1\times10^{15}$ Ω·cm, more preferably from $1\times10^{8}$ Ω·cm to $1\times10^{14}$ Ω·cm, and particularly preferably from $1\times10^{8}$ Ω·cm to $1\times10^{13}$ Ω·cm.

Preparing Method of Carrier

The carrier used in the exemplary may be formed by, for example, preparing a coating solution by dissolving a silicone resin or the like in an organic solvent, then uniformly applying the coating solution to the surface of the core particle by a known coating method and drying the coating solution, and then carrying out sintering. The coating method is not particularly limited and known coating methods may be used. Examples thereof include a dipping method, a spraying method, and a brush coating method.

The organic solvent is not particularly limited and may be appropriately selected according to the purpose. Examples thereof include toluene, xylene, methyl ethyl ketone, methyl isobutyl ketone, cellosolve, and butyl acetate.

The sintering of the resin layer is not particularly limited and an external heating method or internal heating method may be adopted. Examples thereof include a fixing type electric furnace, a flowing type electric furnace, a rotary electric furnace, a burner furnace, and a microwave heater.

The amount of the resin layer is preferably 0.01% by weight to 5.0% by weight with respect to the total weight of the carrier. When the amount of the resin layer is less than 0.01% by weight, a uniform resin layer cannot be formed on the surface of the core. When the amount of the resin layer is more than 5.0% by weight, the resin layer is excessively thick and granulation between the carriers occurs. Thus, uniform carrier particles cannot be obtained.

Image Forming Method

An image forming method using the electrostatic charge image developer of the exemplary embodiment will be described. The electrostatic charge image developer of the exemplary embodiment is used in an image forming method adopting known electrophotography. Specifically, the electrostatic charge image developer is used in an image forming method having the following steps.

That is, a preferable image forming method includes a latent image forming step of forming an electrostatic latent image on a surface of an image holding member, a developing step of developing the electrostatic latent image formed on the surface of the image holding member with a developer including a toner to form a toner image, a transfer step of transferring the toner image to a surface of a transfer medium, and a fixing step of fixing the toner image transferred to the surface of the transfer medium. As the developer, the electrostatic charge image developer of the exemplary embodiment is used. In addition, when an intermediate transfer member serving as a medium for toner image transfer from the image holding member to the transfer medium is used in the transfer step, the effects of the exemplary embodiment are easily exhibited.

In addition, the image forming method may further include a cleaning step of removing the toner remaining on the surface of the image holding member after transfer.

The respective steps are general steps such as those disclosed in JP-A-56-40868 and JP-A-49-91231. The image forming method of the exemplary embodiment may be implemented by using a known image forming apparatus such as a copying machine and a facsimile.

The electrostatic latent image forming step is a step of forming an electrostatic latent image on an image holding member (photoreceptor).

The developing step is a step of developing the electrostatic latent image by the electrostatic charge image developer on the developer holding member to form a toner image.

The transfer step is a step of transferring the toner image to a transfer medium. In addition, as the transfer medium in the transfer step, an intermediate transfer member or a recording medium such as paper may be exemplified.

In the fixing step, for example, a method of fixing the toner image transferred to transfer paper to form a copied image by a heating roller fixing device for setting the temperature of the heating roller to a predetermined temperature may be exemplified.

The cleaning step is a step of removing the electrostatic charge image developer remaining on the image holding member.

As the transfer medium, an intermediate transfer member or a recording medium such as paper may be used.

Examples of the recording medium include paper and an OHP sheet, which are used in a copying machine, a printer or the like of an electrophotographic system, and coated paper obtained by coating the surface of plain paper with a resin or the like, art paper for printing, and the like may be suitably used.

The image forming method of the exemplary embodiment may further contain a recycling step. The recycling step is a process step of moving an electrostatic charge image developing toner collected in the cleaning step, to the developer layer. The image forming method of the exemplary embodiment including the recycling step may be implemented with an image forming apparatus, such as a copying machine and a facsimile machine, with a toner recycling system. The image forming method may also be applied to a recycling system, in which the toner is collected simultaneously with the development without the cleaning step.

Image Forming Apparatus

An image forming apparatus according to the exemplary embodiment is an image forming apparatus using the electrostatic charge image developer of the exemplary embodiment. The image forming apparatus according to the exemplary embodiment will be described.

The image forming apparatus of the exemplary embodiment preferably includes an image holding member, a charging unit that charges the image holding member, an exposing unit that exposes the charged image holding member, to form an electrostatic latent image on the surface of the image holding member, a developing unit that develops the electrostatic latent image with a developer including a toner, to forma toner image, a transferring unit that transfers the toner image from the image holding member to a surface of a transfer medium, and a fixing unit that fixes the toner image transferred to the surface of the transfer medium, and the developer is preferably the electrostatic charge image developer of the exemplary embodiment.

The image forming apparatus of the exemplary embodiment is not particularly limited as long as the image forming apparatus includes at least the image holding member, the charging unit, the exposing unit, the developing unit, the transferring unit and the fixing unit, and may further contain a cleaning unit, an erasing unit and the like, if necessary.

In the case of an intermediate transfer type apparatus, a transfer unit s configured to have, for example, an intermediate transfer member having a surface to which a toner image is to be transferred, a primary transfer unit that primarily transfers a toner image formed on a surface of an image holding member to the surface of the intermediate transfer member, and a secondary transfer unit that secondarily transfers the toner image transferred to the surface of the intermediate transfer member to a surface of a recording medium.

As the image holding member and the respective units, the structure described in each step of the image forming method may be preferably used. As the above each unit, known units in image forming apparatus may be used. The image forming apparatus of the exemplary embodiment may include units and apparatus other than the configuration described above. Further, plural units among the units described above at the same time in the image forming apparatus of the exemplary embodiment may be operated.

Examples of a cleaning unit include a cleaning blade and a cleaning brush.

In the image forming apparatus, for example, a portion including the developing unit may have a cartridge structure (process cartridge) which is detachable from the image forming apparatus. As the process cartridge, a process cartridge that includes at least a developer holding member and contains the electrostatic charge image developer according to the exemplary embodiment is suitably used.

Hereinafter, an example of the image forming apparatus according to the exemplary embodiment will be shown but there is no limitation thereto. In addition, main parts shown in the drawing will be described, and the descriptions of the other parts will be omitted.

The FIGURE is a configuration diagram showing an example of the image forming apparatus according to the exemplary embodiment including a developing device to which the electrostatic charge image developer according to the exemplary embodiment is applied.

In the drawing, image forming apparatus according to the exemplary embodiment includes a photoreceptor 20 as an image holding member which rotates in a predetermined direction (an example of the image holding member), and around this photoreceptor 20, a charging device 21 (an example of the charging unit) which charges the photoreceptor 20, an exposure device 22 (an example of the electrostatic charge image forming unit), for example, as an electrostatic charge image forming device which forms an electrostatic charge image Z on the photoreceptor 20, a developing device 30 (an example of the developing unit) which visualizes the electrostatic charge image Z formed on the photoreceptor 20, a transfer device 24 (an example of the transfer unit) which transfers a toner image which is visualized on the photoreceptor 20 to a recording sheet 28 which is a recording medium, and a cleaning device 25 (an example of the cleaning unit) which cleans toner remaining on the photoreceptor 20 are disposed in order.

In the exemplary embodiment, as shown in the FIGURE, the developing device 30 has a developing container 31 that contains a developer G including a toner 40. The developing container 31 has a developing opening 32 formed to be opposed to the photoreceptor 20, and a developing roll (developing electrode) 33 as a toner holding member arranged to face the developing opening 32. When a predetermined developing bias is applied to the developing roll 33, a developing electric field is formed in a region (developing region) sandwiched between the photoreceptor 20 and the developing roll 33. In the developing container 31, a charge injection roll (injection electrode) 34 as a charge injection member is provided to be opposed to the developing roll 33. Particularly, in the exemplary embodiment, the charge injection roll 34 also acts as a toner supply roller for supplying the toner 40 to the developing roll 33.

Herein, the charge injection roll 34 may be rotated in an arbitrarily selected direction, but in consideration of supply properties of the toner and charge injection properties, it is preferable that the charge injection roll 34 is rotated in the same direction as that of the developing roll 33 at a part opposed to the developing roll 33 with a difference in the peripheral velocity (for example, 1.5 times or greater), and the toner 40 is interposed in a region sandwiched between the charge injection roll 34 and the developing roll 33 and scraped to inject charges.

Next, an operation of the image forming apparatus according to the exemplary embodiment will be described.

When an image forming process is started, first, the surface of the photoreceptor 20 is charged by the charging device 21, the exposure device 22 forms an electrostatic charge image Z on the charged photoreceptor 20, and the developing device 30 visualizes the electrostatic charge image Z as a toner image. Then, the toner image on the photoreceptor 20 is transported to a transfer portion, and the transfer device 24 electrostatically transfers the toner image on the photoreceptor 20 to a recording sheet 28 which is a recording medium. The toner remaining on the photoreceptor 20 is cleaned by the cleaning device 25. Thereafter, the toner image on the recording sheet 28 is fixed by a fixing device 36 (an example of the fixing unit) to obtain an image.

Developer Cartridge and Process Cartridge

A developer cartridge of the exemplary embodiment is a developer cartridge which contains at least the electrostatic charge image developer of the exemplary embodiment.

In addition, it is preferable that the process cartridge according to the exemplary embodiment is a process cartridge which contains the electrostatic charge image developer according to the exemplary embodiment and includes a developer holding member which holds and supplies the electrostatic charge image developer, and is provided with at least one selected from the group consisting of a developing unit which develops an electrostatic latent image formed on an image holding member with the electrostatic charge image developing toner or the electrostatic charge image developer to form a toner image, an image holding member, a charging unit that charges the image holding member, and a cleaning unit for removing the toner remaining on the surface of the image holding member, and the process cartridge is a process cartridge which contains at least the electrostatic charge image developer of the exemplary embodiment.

The developer cartridge of the exemplary embodiment is not particularly limited as long as the developer cartridge contains the electrostatic charge image developer of the exemplary embodiment. The developer cartridge is detachable from an image forming apparatus provided with a developing unit and contains the electrostatic charge image developer of the exemplary embodiment as the developer to be supplied to the developing unit.

In addition, the developer cartridge may be a cartridge which contains a toner and a carrier or may have a cartridge which contains only a toner and a cartridge which contains only a carrier, separately.

The process cartridge of the exemplary embodiment is preferably detachable from an image forming apparatus.

In addition, the process cartridge of the exemplary embodiment may additionally include other members such as an erasing unit if necessary.

The process cartridge may adopt a known configuration.

The developer cartridge and the process cartridge each may have a container that contains the electrostatic charge image developer according to the exemplary embodiment.

EXAMPLES

Hereinafter, the exemplary embodiment will be described in detail with reference to Examples and Comparative Examples, but the exemplary embodiment is not limited to these examples.

In the following examples, unless specified otherwise, "part" represents "part by weight" and "%" represents "% by weight".

Measurement Method

The ratio (C/D), the volume-average particle diameter, and the number-average particle diameter of the toner, the amount of the brilliant pigment exposed, the content of the siloxane oligomer, and the volume intrinsic resistance of the core particles are measured as the following manner, receptively.

Preparation of Toner Particle 1

Synthesis of Organic Fine Particle Emulsion 700 parts of water, 11 parts of a sodium salt of sulfate ester of methacrylic acid ethylene oxide adduct (ELEMINOL RS-30, manufactured by Sanyo Chemical Industries, Ltd.), 80 parts of styrene, 80 parts of methacrylic acid, 100 parts of butyl acrylate, and 1 part of ammonium persulfate are put into a reaction vessel equipped with a stirring rod and a thermometer and stirred at 400 revolutions/min for 15 minutes, thereby obtaining a white emulsion. The emulsion is heated and the temperature in the system is increased to 75° C., followed by allowing to react for 5 hours. Further, 30 parts of a 1% aqueous ammonium persulfate solution is added thereto and the mixture is aged at 75° C. for 5 hours, thereby obtaining Aqueous dispersion fine particle dispersion 1 of vinyl resin (styrene-methacrylic acid-butyl acrylate-methacrylic acid ethylene oxide adduct sulfonate sodium salt copolymer).

Preparation of Water Phase 990 parts of water, 80 parts of the fine particle dispersion 1, 40 parts of an 48.5% aqueous solution of dodecyl diphenyl ether disulfonic acid sodium (ELEMINOL MON-7): Sanyo Chemical Industries, Ltd.), and 90 parts of ethyl acetate are mixed and stirred to obtain a milky liquid, Water phase 1.

Synthesis of Low Molecular Weight Polyester 230 parts of an ethylene oxide (2 mol) adduct of bisphenol A, 530 parts of a propylene oxide (3 mol) adduct of bisphenol A, 210 parts of terephthalic acid, 50 parts of adipic acid, and 2 parts of dibutyltin oxide are put into a reaction vessel equipped with a cooling pipe, a stirrer, and a nitrogen inlet pipe and allowed to react under normal pressure at 230° C. for 8 hours, and further allowed to react under a reduced pressure of 10 mmHg to 15 mmHg for 5 hours. The reaction vessel is charged with 44 parts of trimellitate anhydride and the mixture is allowed to react under normal pressure at 180° C. for 2 hours. Thus, Low molecular weight polyester 1 is obtained. Low molecular weight polyester 1 has a number-average molecular weight of 2,700, a weight-average molecular weight of 6,500, a Tg of 45° C., and an acid value of 20.

Synthesis of Intermediate Polyester 700 parts of an ethylene oxide (2 mol) adduct of bisphenol A, 80 parts of a propylene oxide (2 mol) adduct of bisphenol A, 280 parts of terephthalic acid, 30 parts of trimellitate anhydride, and 2 parts of dibutyltin oxide are put into a reaction vessel equipped with a cooling pipe, a stirrer, and a nitrogen inlet pipe, allowed to react under normal pressure at 230° C. for 8 hours, and further allowed to react under a reduced pressure of 10 mmHg to 13 mmHg for 5 hours. Thus, Intermediate polyester 1 is obtained. Intermediate polyester 1 has a number-average molecular weight of 2,000, a weight-average molecular weight of 90,000, a Tg of 55° C., an acid value of 0.5, and a hydroxyl value of 45.

Next, 1,410 parts of the intermediate polyester, 89 parts of isophorone diisocyanate, and 500 parts of ethyl acetate are put into a reaction vessel equipped with a cooling pipe, a stirrer, and a nitrogen inlet pipe, and allowed to react at 100° C. for 5 hours, thereby obtaining Prepolymer 1.

Synthesis of Ketimine 200 parts of isophoronediamine and 80 parts of methyl ethyl ketone are out into a reaction vessel equipped with a stirring rod and a thermometer and allowed to react at 50° C. for 5 hours, thereby obtaining Ketimine compound 1.

Treatment of Pigment 100 parts of an aluminum pigment (2173EA, manufactured by Showa Aluminum Powder K.K), 700 parts of sodium chloride, 100 parts of rosin modified maleic acid resin, and 160 parts of polyethylene glycol are put and kneaded using a three-roll mill for 3 hours. Next, the mixture is put into about 3 L of warm water, and stirred with a high speed mixer for 1 hour while heating at 80° C. to form slurry. The slurry is filtered and washed with water to remove the sodium chloride and polyethylene glycol. The resultant is vacuum-dried with a hot air oven at 60° C. for 24 hours to obtain treated Aluminum pigment 1.

Synthesis of Masterbatch 900 parts of water, 400 parts of Aluminum pigment 1, 2.0 parts of an anionic surfactant (NEOGEN R, manufactured by Dai-ichi Kogyo Seiyaku Co., Ltd.), and 1,200 parts of polyester resin are added and mixed using a HENSCHEL mixer (manufactured by MITSUI MIIKE MACHINERY Co., Ltd.). The mixture is kneaded using a two-roll mill at 150° C. for 30 minutes then rolled and cooled, and pulverized by a pulverizer. Thus, Masterbatch 1 is obtained.

Preparation of Oil Phase 400 parts of the low molecular weight polyester 1, 110 parts of ester wax, 30 parts of CCA (salicylic acid metal complex E-84, manufactured by Orient Chemical Industries Co., Ltd.), and 950 parts of ethyl acetate are put into a reaction vessel equipped with a stirring rod and a thermometer, and the temperature is increased to 80° C. under stirring. While maintaining the temperature at 80° C., the mixture is held for 5 hours and then cooled to 30° C. for 1 hour. Next, 500 parts of masterbatch 1, 500 parts of ethyl acetate are put into the vessel and mixed for 1 hour to obtain raw material solution 1.

1,300 parts of raw material solution 1 is poured into the vessel is subjected to a dispersion treatment using a beads mill (ULTRA VISCO MILL, manufactured by AIMEX Corporation), filled with 80% by volume of zirconia beads having a diameter of 0.5 mm, under the conditions of a liquid feeding speed of 1 kg/hour, a disc peripheral speed of 6 m/second. The dispersion treatment is carried out 3 passes to disperse the pigment and the wax. After adding 1,300 parts of a 65% ethyl acetate solution of low molecular weight polyester 1, the resulting mixture is subjected to the above dispersion treatment 1 pass using the beads mill under the conditions. Thus, Pigment/WAX dispersion 1 is obtained. The solid content of Pigment/WAX dispersion 1 (130° C., 30 minutes) is 50%.

Emulsification and Solvent Removal 750 parts of Pigment/WAX dispersion 1, 115 parts of Prepolymer 1, and 3.0 parts of Ketimine compound 1 are put into a vessel and mixed using a TK HOMOMIXER (manufactured by Primix Corporation) at a 5,000 rpm for 1 minute. 1,200 parts of Water phase 1 is added to the vessel and the materials are mixed using the TK HOMOMIXER at a revolution of 13,000 rpm for 20 minutes. Then, Emulsion slurry 1 is obtained. Emulsion slurry 1 is poured into to a vessel equipped with a stirrer and a thermometer and the solvent is removed at 50° C. for 4 hours. Then, the resultant is aged at 45° C. for 4 hours to obtain Dispersion slurry 1. Dispersion slurry 1 has a volume-average particle diameter of 5.99 μm, a number-average particle diameter of 5.70 μm (measured by a COULTER MULTISIZER II).

Washing and Drying 100 parts of Dispersion slurry 1 is filtered under reduced pressure and then 100 parts of ion-exchange water is added to the filtered cake. The materials are mixed using a TK HOMOMIXER (at a revolution of 12,000 rpm for 10 minutes), followed by filtering. To the filtered cake, 100 parts of a 10% aqueous sodium hydroxide solution is added, and the material are mixed using a TK HOMOMIXER (at a revolution of 12,000 rpm for 30 minutes), followed by filtering under reduced pressure. 100 parts of a 10% hydrochloric acid is added to the filtered cake and the materials are mixed using a TK HOMOMIXER (at a revolution of 12,000 rpm for 10 minutes), followed by filtering. To the filtered cake, 300 parts of ion-exchange water is added and the materials are mixed using a TK HOMOMIXER (at a revolution of 12,000 rpm for 10 minutes), followed by filtering. Then, this operation is repeated twice. Thus, Filtered cake 1 is obtained. Filtered cake 1 is dried by a drier at 45° C. for 48 hours and then sieved with a mesh having openings of 75 μm. Thus, Toner particles 1 are obtained. The exposed amount of the brilliant pigment by XPS is 0.5%, and the ratio C/D is 0.1.

Preparation of Toner 1

1.0 part of titanium oxide particles (JMT-150IB, volume average particle diameter: 15 nm, manufactured by Tayca Corporation), and 1.5 parts of silica particles (AEROSIL RY50, volume average particle diameter: 40 nm, manufactured by Nippon Aerosil Co., Ltd.) are mixed with respect to 100 parts of Toner particles 1 using a HENSCHEL MIXER at 10,000 rpm for 30 seconds, and then sieved with a mesh having openings of 45 μm. Thus, Toner 1 is prepared.

Preparation of Toner 2

Toner 2 is prepared in the same manner as in the preparation of Toner 1 except that in the emulsification and solvent removal step, Pigment/WAX dispersion 1, Prepolymer 1, and Ketimine compound 1 are put into a vessel and mixed using a TK HOMOMIXER (manufactured by Primix Corporation) at 4,000 rpm for 1 minute. In obtained Toner 2, the exposed amount of the brilliant pigment is 2%, and the ratio C/D is 0.1.

Preparation of Toner 3

Toner 3 is prepared in the same manner as in the preparation of Toner 1 except that in the emulsification and solvent removal step, Pigment/WAX dispersion 1, Prepolymer 1, and Ketimine compound 1 are put into a vessel and mixed using a TK HOMOMIXER (manufactured by Primix Corporation) at 3,000 rpm for 1 minute. In obtained Toner 3, the exposed amount of the brilliant pigment is 5%, and the ratio C/D is 0.1.

Preparation of Toner 4

Toner 4 is prepared in the same manner as in the preparation of Toner 1 except that Emulsion slurry 1 is poured into a vessel and the solvent is removed at 40° C. for 6 hours. In obtained Toner 4, the exposed amount of the brilliant pigment is 0.5%, and the ratio C/D is 0.4.

Preparation of Toner 5

Toner 5 is prepared in the same manner as in the preparation of Toner 1 except that Pigment/WAX dispersion 1, Prepolymer 1, and Ketimine compound 1 are put into a vessel and mixed using a TK HOMOMIXER (manufactured by Primix Corporation) at 4,000 rpm for 1 minute, and the solvent is removed at 40° C. for 6 hours. In e obtained Toner 5, the exposed amount of the brilliant pigment is 2%, and the ratio C/D is 0.4.

Preparation of Toner 6

Toner 6 is prepared in the same manner as in the preparation of Toner 1 except that Pigment/WAX dispersion 1, Prepolymer 1, and Ketimine compound 1 are put into a vessel and mixed using a TK HOMOMIXER (manufactured by Primix Corporation) at 3,000 rpm for 1 minute, and the solvent is removed at 40° C. for 6 hours. In obtained Toner 6, the exposed amount of the brilliant pigment is 5%, and the ratio C/D is 0.4.

Preparation of Toner 7

Toner 7 is prepared in the same manner as in the preparation of Toner 1 except that Emulsion slurry 1 is poured into a vessel and the solvent is removed at 40° C. for 8 hours. In obtained Toner 7, the exposed amount of the brilliant pigment is 0.5%, and the ratio C/D is 0.7.

Preparation of Toner 8

Toner 8 is prepared in the same manner as in the preparation of Toner 1 except that Pigment/WAX dispersion 1, Prepolymer 1, and Ketimine compound 1 are put into a vessel and mixed using a TK HOMOMIXER (manufactured by Primix Corporation) at 4,000 rpm for 1 minute, and the solvent is removed at 40° C. for 8 hours. In obtained Toner 8, the exposed amount of the brilliant pigment is 2%, and the ratio C/D is 0.7.

Preparation of Toner 9

Toner 9 is prepared in the same manner as in the preparation of Toner 1 except that Pigment/WAX dispersion 1, Prepolymer 1, and Ketimine compound 1 are put into a vessel and mixed using a TK HOMOMIXER (manufactured by Primix Corporation) at 3,000 rpm for 1 minute, and the solvent is removed at 40° C. for 8 hours. In obtained Toner 9, the exposed amount of the brilliant pigment is 5%, and the ratio C/D is 0.7.

Preparation of Toner 10

Toner 10 is prepared in the same manner as in the preparation of Toner 1 except that Emulsion slurry 1 is poured into a vessel and the solvent is removed at 40° C. for 12 hours. In obtained Toner 10, the exposed amount of the brilliant pigment is 0.5%, and the ratio C/D is 0.9.

Preparation of Toner 11

Toner 11 is prepared in the same manner as in the preparation of Toner 1 except that Pigment/WAX dispersion 1, Prepolymer 1, and Ketimine compound 1 are put into a vessel and mixed using a TK HOMOMIXER (manufactured by Primix Corporation) at 4,000 rpm for 1 minute, and the solvent is removed at 40° C. for 12 hours. In obtained Toner 11, the exposed amount of the brilliant pigment is 2%, and the ratio C/D is 0.9.

Preparation of Toner 12

Toner 12 is prepared in the same manner as in the preparation of Toner 1 except that Pigment/WAX dispersion 1, Prepolymer 1, and Ketimine compound 1 are put into a vessel and mixed using a TK HOMOMIXER (manufactured by Primix Corporation) at 3,000 rpm for 1 minute, and the solvent is removed at 40° C. for 12 hours. In obtained Toner 12, the exposed amount of the brilliant pigment is 5%, and the ratio C/D is 0.9.

Preparation of Toner 13

Toner 13 is prepared in the same manner as in the preparation of Toner 1 except that Emulsion slurry 1 is poured into a vessel and the solvent is removed at 30° C. for 8 hours. In obtained Toner 13, the exposed amount of the brilliant pigment is 0.5%, and the ratio C/D is 1.2.

Preparation of Toner 14

Toner 14 is prepared in the same manner as in the preparation of Toner 1 except that Pigment/WAX dispersion 1, Prepolymer 1, and Ketimine compound 1 are put into a vessel and mixed using a TK HOMOMIXER (manufactured by Primix Corporation) at 4,000 rpm for 1 minute, and the solvent is removed at 30° C. for 8 hours. In obtained Toner 14, the exposed amount of the brilliant pigment is 2%, and the ratio C/D is 1.2.

Preparation of Toner 15

Toner 15 is prepared in the same manner as in the preparation of Toner 1 except that Pigment/WAX dispersion 1, Prepolymer 1, and Ketimine compound 1 are put into a vessel and mixed using a TK HOMOMIXER (manufactured by Primix Corporation) at 3,000 rpm for 1 minute, and the solvent is removed at 30° C. for 8 hours. In obtained Toner 15, the exposed amount of the brilliant pigment is 5%, and the ratio C/D is 1.2.

Preparation of Comparative Toner 1

Comparative toner 1 is prepared in the same manner as in the preparation of Toner 1 except that in the emulsification and solvent removal step, Pigment/WAX dispersion 1, Prepolymer 1, and Ketimine compound 1 are put into a vessel and mixed using a TK HOMOMIXER (manufactured by Primix Corporation) at 5,000 rpm for 2 minutes, and the solvent is removed at 60° C. for 5 hours. In obtained Comparative toner 1, the exposed amount of the brilliant pigment is 0%, and the ratio C/D is 0.05.

Preparation of Comparative Toner 2

Comparative toner 2 is prepared in the same manner as in the preparation of Comparative toner 1 except that mixing is carried out using a TK HOMOMIXER (manufactured by Primix Corporation) at 4,000 rpm for 1 minute. In obtained Comparative toner 2, the exposed amount of the brilliant pigment is 0.5%, and the ratio C/D is 0.05.

Preparation of Comparative Toner 3

Comparative toner 3 is prepared in the same manner as in the preparation of Comparative toner 1 except that that mixing is carried out using a TK HOMOMIXER (manufactured by Primix Corporation) at 4,000 rpm for 1 minute. In obtained Comparative toner 3, the exposed amount of the brilliant pigment is 2%, and the ratio C/D is 0.05.

Preparation of Comparative Toner 4

Comparative toner 4 is prepared in the same manner as in the preparation of Comparative toner 1 except that that mixing is carried out using a TK HOMOMIXER (manufactured by Primix Corporation) at 3,000 rpm for 1 minute. In obtained Comparative toner 4, the exposed amount of the brilliant pigment is 5%, and the ratio C/D is 0.05.

Preparation of Comparative Toner 5

Comparative toner 5 is prepared in the same manner as in the preparation of Comparative toner 1 except that that mixing is carried out using a TK HOMOMIXER (manufactured by Primix Corporation) at 2,000 rpm for 1 minute. In obtained Comparative toner 5, the exposed amount of the brilliant pigment is 6%, and the ratio C/D is 0.05.

Preparation of Comparative Toner 6

Comparative toner 6 is prepared in the same manner as in the preparation of Toner 1 except that in the emulsification and solvent removal step, Pigment/WAX dispersion 1, Prepolymer 1, and Ketimine compound 1 are put into a vessel and mixed using a TK HOMOMIXER (manufactured by Primix Corporation) at 5,000 rpm for 2 minutes, and the solvent is removed at 50° C. for 4 hours. In obtained Comparative toner 6, the exposed amount of the brilliant pigment is 0%, and the ratio C/D is 0.1.

Preparation of Comparative Toner 7

Comparative toner 7 is prepared in the same manner as in the preparation of Toner 1 except that in the emulsification and solvent removal step, Pigment/WAX dispersion 1, Prepolymer 1, and Ketimine compound 1 are put into a vessel and mixed using a TK HOMOMIXER (manufactured by Primix Corporation) at 2,000 rpm for 1 minute. In obtained Comparative toner 7, the exposed amount of the brilliant pigment is 6%, and the ratio C/D is 0.1.

Preparation of Comparative Toner 8

Comparative toner 8 is prepared in the same manner as in the preparation of Toner 1 except that the solvent is removed from Comparative toner 1 at 40° C. for 6 hours. In obtained Comparative toner 8, the exposed amount of the brilliant pigment is 0%, and the ratio C/D is 0.4.

Preparation of Comparative Toner 9

Comparative toner 9 is prepared in the same manner as in the preparation of Toner 1 except that the solvent is removed from Comparative toner 7 at 40° C. for 6 hours. In obtained Comparative toner 9, the exposed amount of the brilliant pigment is 6%, and the ratio C/D is 0.4.

Preparation of Comparative Toner 10

Comparative toner 10 is prepared in the same manner as in the preparation of Toner 1 except that the solvent is removed from Comparative toner 1 at 40° C. for 8 hours. In obtained Comparative toner 10, the exposed amount of the brilliant pigment is 0%, and the ratio C/D is 0.7.

Preparation of Comparative Toner 11

Comparative toner 11 is prepared in the same manner as in the preparation of Toner 1 except that the solvent is removed from Comparative toner 7 at 40° C. for 6 hours. In obtained Comparative toner 11, the exposed amount of the brilliant pigment is 6%, and the ratio C/D is 0.7.

Preparation of Comparative Toner 12

Comparative toner 12 is prepared in the same manner as in the preparation of Toner 1 except that the solvent is removed from Comparative toner 1 at 40° C. for 12 hours. In obtained Comparative toner 12, the exposed amount of the brilliant pigment is 0%, and the ratio C/D is 0.9.

Preparation of Comparative Toner 13

Comparative toner 13 is prepared in the same manner as in the preparation of Toner 1 except that the solvent is removed from Comparative toner 7 at 40° C. for 12 hours. In obtained Comparative toner 13, the exposed amount of the brilliant pigment is 6%, and the ratio C/D is 0.9.

Preparation of Comparative Toner 14

Comparative toner 14 is prepared in the same manner as in the preparation of Toner 1 except that the solvent is removed from Comparative toner 1 at 30° C. for 8 hours. In obtained Comparative toner 14, the exposed amount of the brilliant pigment is 0%, and the ratio C/D is 1.2.

Preparation of Comparative Toner 15

Comparative toner 15 is prepared in the same manner as in the preparation of Toner 1 except that the solvent is removed from Comparative toner 7 at 40° C. for 6 hours. In obtained Comparative toner 15, the exposed amount of the brilliant pigment is 6%, and the ratio C/D is 1.2.

Preparation of Comparative Toner 16

Comparative toner 16 is prepared in the same manner as in the preparation of Toner 1 except that the solvent is removed from Comparative toner 1 at 30° C. for 12 hours. In obtained Comparative toner 16, the exposed amount of the brilliant pigment is 0%, and the ratio C/D is 1.3.

Preparation of Comparative Toner 17

Comparative toner 17 is prepared in the same manner as in the preparation of Toner 1 except that the solvent is removed from Toner 1 at 30° C. for 12 hours. In obtained Comparative toner 17, the exposed amount of the brilliant pigment is 0.5%, and the ratio C/D is 1.3.

Preparation of Comparative Toner 18

Comparative toner 18 is prepared in the same manner as in the preparation of Toner 1 except that the solvent is removed from the toner 2 at 30° C. for 12 hours. In obtained Comparative toner 18, the exposed amount of the brilliant pigment is 2%, and the ratio C/D is 1.3.

Preparation of Comparative Toner 19

Comparative toner 19 is prepared in the same manner as in the preparation of Toner 1 except that the solvent is removed from the toner 3 at 30° C. for 12 hours. In obtained Comparative toner 19, the exposed amount of the brilliant pigment is 5%, and the ratio C/D is 1.3.

Preparation of Comparative Toner 20

Comparative toner 20 is prepared in the same manner as in the preparation of Toner 1 except that the solvent is removed from Comparative toner 5 at 30° C. for 12 hours. In obtained Comparative toner 20, the exposed amount of the brilliant pigment is 6%, and the ratio C/D is 1.3.

Preparation of Siloxane Oligomer 1

17.9 g of aminopropyltriethoxysilane, and 80 g of PGMEA are out into a flask, and an aqueous phosphoric acid solution obtained by dissolving 0.17 g of phosphoric acid in 50 g of water is added thereto for 10 minutes while stirring at room temperature. Then, the flask is dipped in a 40° C. oil bath under stirring for 60 minutes. The temperature of the oil bath is then increased to 115° C. for 30 minutes. After 1 hour has passes from the temperature increase, the temperature inside the solution reaches 100° C. and from this point, the flask is heated and stirred for 1 hour, thereby obtaining a silane oligomer solution. An oil phase is extracted from the obtained silane oligomer solution and separated by column chromatography. Thus, silane oligomer is obtained.

Preparation of Ferrite Particle 1

100 parts by weight of $Fe_2O_3$, 20 parts by weight of $MnO_2$, and 0.50 parts by weight of $SrCO_3$ are mixed and the mixture is pulverized using a wet ball mill for 10 hours. The resultant is dried and then temporarily sintered using a rotary kiln in an atmospheric environment at 850° C. for 4 hours. Water is added to the obtained temporarily sintered substance and pulverized using a wet ball mill for 7 hours to obtain slurry. Appropriate amounts of dispersant and binder are added to the obtained slurry and then the resultant is granulated and dried by a spray dryer. Thus, granules are obtained. The obtained granules are sintered in an electric furnace at 1,100° C. for 8 hours. The granules obtained through a crushing step and a classifying step is subjected to a heating step in an atmospheric environment at 500° C. for 2 hours. Thus, Ferrite particle 1 having a volume-average particle diameter of 35 μm and a volume intrinsic resistance ratio of a core particle of 0.9 is obtained.

Preparation of Ferrite Particle 2

Granules obtained using a spray drier are sintered in an electric furnace at 950° C. for 6 hours. The granules are subjected to a crushing step and a classifying step and not subjected to a heating step. Thus, Ferrite particle 2 having a volume-average particle diameter of 35 μm and a volume intrinsic resistance ratio of a core particle of 0.7 is obtained.

Preparation of Carrier 1

Carbon black (FW2, manufactured by Degussa AG): 3 parts

Aminosilane coupling agent (aminopropyltrimethoxy-silane): 3 parts

Silicone resin (SR2400, non-volatile content: 50%, manufactured by Dow Corning Toray Silicone Co., Ltd.): 200 parts Siloxane oligomer 1: 0.012 parts Toluene: 300 parts A mixture of the above materials is dispersed using a homomixer for 20 minutes to prepare a coating layer forming solution. Using a fluid bed coating device, the coating layer forming solution is applied to the surface of Ferrite particle 1 and a coating layer having a thickness of about 0.5 μm is formed at an environment temperature of 250° C. Thus, Carrier 1 is formed.

The content of the siloxane oligomer of Carrier 1 is 0.5 ppm.

Preparation of Carrier 2

Carrier 2 is prepared in the same manner as in the preparation of Carrier 1 except that the amount of the siloxane oligomer is changed to 2.2 parts.

Preparation of Carrier 3

Carrier 3 is prepared in the same manner as in the preparation of Carrier 1 except that the amount of the siloxane oligomer is changed to 10.1 parts.

Preparation of Carrier 4

Carrier 4 is prepared in the same manner as in the preparation of Carrier 1 except that the silicone resin (SR2400, non-volatile content: 50%, manufactured by Dow Corning Toray Silicone Co., Ltd.) is changed to alkyd modified silicone resin (KR206, manufactured by Shin-Etsu Chemical Co., Ltd).

Preparation of Comparative Carrier 1

Comparative Carrier 1 is prepared in the same manner as in the preparation of Carrier 1 except that the amount of the siloxane oligomer is changed to 0.012 parts.

Preparation of Comparative Carrier 2

Comparative Carrier 2 is prepared in the same manner as in the preparation of Carrier 1 except that the amount of the siloxane oligomer is changed to 12.2 parts.

Preparation of Carrier 5

Carrier 5 is prepared in the same manner as in the preparation of Carrier 2 except that Ferrite particle 2 is used.

Preparation of Developers 1 to 75 and Comparative Developers 1 to 170

100 parts of each carrier shown in Tables 1 to 7 below and 10 parts of each toner shown in Tables 1 to 7 below are stirred using a V-blender at 40 rpm for 20 minutes and each mixture is allowed to pass through a sieve having an opening of 106 μm. Thus, Developers 1 to 75 and Comparative developer 1 to 170 are obtained.

Evaluation

In the respective Examples and Comparative examples, a developing unit of a DOCUCENTRE-III C7600, manufactured by Fuji Xerox Co., Ltd., is filled with the developer shown in Tables 1 to 7 and the developer is kept to stand overnight in a high temperature and low humidity environment (30° C., relative humidity of 20%). Then, Tests 1 to 3 below are carried out.

Test 1: A rectangular shape patch image sample A having a size of 3 cm×25 cm is formed on 30,000 sheets of plain paper (C2 paper, manufactured by Fuji Xerox Co., Ltd.) at a fixing temperature of 180° C. by continuous double side printing.

Test 2: A rectangular shape patch image sample B having a size of 18 cm×25 cm is formed on 30,000 sheets by continuous double side printing on the following day after the operation in Test 1 in a high temperature high humidity (30° C., 90% RH) environment. The recording sheet, the fixing conditions, and the like are the same as in Test 1.

Test 3: The image A is printed and output on one surface of 10 sheets in the early morning on the following day after the developer is kept to stand for 24 hours in a high temperature high humidity (30° C., 90% RH) environment after the operation in Test 2. The recording sheet the fixing conditions, and the like are the same as in Test 1.

Evaluation of Deletion

In Test 2, when the image B is printed, the image is observed in every 1,000th print and the amount of the developer on the magnet roller in the developing unit is evaluated in a visual and sensory manner. The evaluation is carried out based on the following evaluation criteria. The evaluation results are shown in Tables 1 to 7. The evaluation results are preferably A or B and more preferably A.

A: Deletion is not observed in the image and a change in the amount of the developer on the magnet roller is not observed.

B: Deletion is not observed in the image and a slight change in the amount of the developer on the magnet roller is observed.

C: Deletion is slightly observed in the image and the amount of the developer on the portions of the magnet roller corresponding to portions having deletion is reduced.

D: Deletion is clearly observed in the image and the amount of the developer on the portions of the magnet roller corresponding to portions having deletion is apparently reduced.

Evaluation of Color Spots

In Test 2, when the image B is printed, the images of the first to 100th sheets are observed and then the images of the 1,001th to 1,100th sheets are observed. In this manner, the images of 100 sheets are repeatedly observed in every 1,000th print. While images of 30,000 sheets are being formed, the number of color spots is counted from image samples formed on total 3,000 sheets. The evaluation is carried out base on the following evaluation criteria. The evaluation results are shown in Tables 1 to 7. The evaluation results are preferably A or B and more preferably A.

A: The number of color spots in the image is from 0 to 1.

B: The number of color spots in the image is more than 1 and 3 or less.

C: The number of color spots in the image is more than 3 and 30 or less.

D: The number of color spots in the image is more than 30.

Evaluation of Density Stability

In Tests 1 and 2, the images A and B are printed, the density of the images on the first to 100th sheets is measured and then the density of the images on the 1,001th to 1,100th sheets is measured. In this manner, the density of the images of 100 sheets is repeatedly measured in every 1,000th print, and while a total of 60,000 sheets of images are being formed, chrominance is measured from image samples formed on total 6,000 sheets.

$\Delta E(L^{*2}+a^{*2}+b^{*2})^{0.5}$=chrominance between image sample on first sheet between arbitrary image sample As the above ΔE decreases, the density stability becomes further excellent.

The evaluation is carried out based on the following evaluation criteria. The evaluation results are shown in Tables 1 to 7. The evaluation results are preferably A, B+ or B−, more preferably A or B+, and still more preferably A. The chrominance is measured with an image densitometer X-RITE 938 (manufactured by X-RITE Inc.).

A: ΔE is 0 or more and less than 3.

B+: ΔE is 3 or more and less than 5.

B−: ΔE is 5 or more and less than 6.

C: ΔE is 6 or more and less than 10.

D: ΔE is 10 or more.

Initial Fogging After Being Left

The degree of contamination in the device after printing in non-image portions when 10 sheets of images A are printed in the early morning on the following day after the developer is kept for 24 hours is evaluated. The evaluation is carried out based on the following evaluation criteria. The evaluation results are shown in Tables 1 to 7. The evaluation results are preferably A, B+, or B−, more preferably A or B+, and still more preferably A.

A: Toner scattering does not occur in the device, fogging is not observed on the image, and there is no problem in image quality.

B+: Toner scattering occurs in the device, but fogging is not observed on the image, and there is no problem in image quality.

B−: Slight fogging is observed on the image and there is no practical problem.

C: Slight fogging is observed on the image and is at a level causing a practical problem.

D: Fogging is clearly observed on the image.

TABLE 1

| | Developer | Toner | Amount of pigment exposed (%) | C/D | Carrier | Content of siloxane oligomer (ppm) | Deletion | Color spots | Density stability | Initial fogging after being kept to stand |
|---|---|---|---|---|---|---|---|---|---|---|
| Comparative example 1 | Comparative developer 1 | Comparative toner 1 | 0 | 0.05 | Comparative carrier 1 | 0.05 | D | D | D | B+ |
| Comparative example 2 | Comparative developer 2 | Comparative toner 2 | 0.5 | | | | D | D | D | C |
| Comparative example 3 | Comparative developer 3 | Comparative toner 3 | 2 | | | | D | D | D | C |
| Comparative example 4 | Comparative developer 4 | Comparative toner 4 | 5 | | | | D | D | D | C |
| Comparative example 5 | Comparative developer 5 | Comparative toner 5 | 6 | | | | D | D | D | D |
| Comparative example 6 | Comparative developer 6 | Comparative toner 6 | 0 | 0.1 | | | D | D | D | B+ |
| Comparative example 7 | Comparative developer 7 | Toner 1 | 0.5 | | | | D | D | D | C |
| Comparative example 8 | Comparative developer 8 | Toner 2 | 2 | | | | D | D | D | C |
| Comparative example 9 | Comparative developer 9 | Toner 3 | 5 | | | | D | D | D | C |
| Comparative example 10 | Comparative developer 10 | Comparative toner 7 | 6 | | | | D | D | D | D |
| Comparative example 11 | Comparative developer 11 | Comparative toner 8 | 0 | 0.4 | | | D | D | D | B+ |
| Comparative example 12 | Comparative developer 12 | Toner 4 | 0.5 | | | | C | C | C | C |
| Comparative example 13 | Comparative developer 13 | Toner 5 | 2 | | | | C | C | C | C |
| Comparative example 14 | Comparative developer 14 | Toner 6 | 5 | | | | C | C | C | C |
| Comparative example 15 | Comparative developer 15 | Comparative toner 9 | 6 | | | | D | D | D | D |
| Comparative example 16 | Comparative developer 16 | Comparative toner 10 | 0 | 0.7 | | | D | D | D | B+ |
| Comparative example 17 | Comparative developer 17 | Toner 7 | 0.5 | | | | C | C | C | C |
| Comparative example 18 | Comparative developer 18 | Toner 8 | 2 | | | | C | C | C | C |
| Comparative example 19 | Comparative developer 19 | Toner 9 | 5 | | | | C | C | C | C |
| Comparative example 20 | Comparative developer 20 | Comparative toner 11 | 6 | | | | D | D | D | D |
| Comparative example 21 | Comparative developer 21 | Comparative toner 12 | 0 | 0.9 | | | D | D | D | B+ |
| Comparative example 22 | Comparative developer 22 | Toner 10 | 0.5 | | | | C | C | C | C |
| Comparative example 23 | Comparative developer 23 | Toner 11 | 2 | | | | C | C | C | C |
| Comparative example 24 | Comparative developer 24 | Toner 12 | 5 | | | | C | C | C | C |
| Comparative example 25 | Comparative developer 25 | Comparative toner 13 | 6 | | | | D | D | D | D |
| Comparative example 26 | Comparative developer 26 | Comparative toner 14 | 0 | 1.2 | | | D | D | D | B+ |
| Comparative example 27 | Comparative developer 27 | Toner 13 | 0.5 | | | | C | C | C | C |
| Comparative example 28 | Comparative developer 28 | Toner 14 | 2 | | | | C | C | C | C |
| Comparative example 29 | Comparative developer 29 | Toner 15 | 5 | | | | C | C | C | C |
| Comparative example 30 | Comparative developer 30 | Comparative toner 15 | 6 | | | | D | D | D | D |
| Comparative example 31 | Comparative developer 31 | Comparative toner 16 | 0 | 1.3 | | | D | D | D | B+ |
| Comparative example 32 | Comparative developer 32 | Comparative toner 17 | 0.5 | | | | C | C | C | C |

TABLE 1-continued

| | Developer | Toner | Amount of pigment exposed (%) | C/D | Carrier | Content of siloxane oligomer (ppm) | Deletion | Color spots | Density stability | Initial fogging after being kept to stand |
|---|---|---|---|---|---|---|---|---|---|---|
| Comparative example 33 | Comparative developer 33 | Comparative toner 18 | 2 | | | | C | C | C | C |
| Comparative example 34 | Comparative developer 34 | Comparative toner 19 | 5 | | | | C | C | C | C |
| Comparative example 35 | Comparative developer 35 | Comparative toner 20 | 6 | | | | D | D | D | D |

TABLE 2

| | Developer | Toner | Amount of pigment exposed (%) | C/D | Carrier | Content of siloxane oligomer (ppm) | Deletion | Color spots | Density stability | Initial fogging after being kept to stand |
|---|---|---|---|---|---|---|---|---|---|---|
| Comparative example 36 | Comparative developer 36 | Comparative toner 1 | 0 | 0.05 | Carrier 1 | 0.1 | D | D | D | D |
| Comparative example 37 | Comparative developer 37 | Comparative toner 2 | 0.5 | | | | C | C | C | C |
| Comparative example 38 | Comparative developer 38 | Comparative toner 3 | 2 | | | | C | C | C | C |
| Comparative example 39 | Comparative developer 39 | Comparative toner 4 | 5 | | | | C | C | C | C |
| Comparative example 40 | Comparative developer 40 | Comparative toner 5 | 6 | | | | D | D | D | D |
| Comparative example 41 | Comparative developer 41 | Comparative toner 6 | 0 | 0.1 | | | D | D | D | D |
| Example 1 | Developer 1 | Toner 1 | 0.5 | | | | B | B | B+ | B+ |
| Example 2 | Developer 2 | Toner 2 | 2 | | | | B | B | B+ | B+ |
| Example 3 | Developer 3 | Toner 3 | 5 | | | | B | B | B+ | B+ |
| Comparative example 42 | Comparative developer 42 | Comparative toner 7 | 6 | | | | D | D | D | D |
| Comparative example 43 | Comparative developer 43 | Comparative toner 8 | 0 | 0.4 | | | D | D | D | D |
| Example 4 | Developer 4 | Toner 4 | 0.5 | | | | B | B | B+ | B+ |
| Example 5 | Developer 5 | Toner 5 | 2 | | | | A | A | A | A |
| Example 6 | Developer 6 | Toner 6 | 5 | | | | B | B | B+ | B+ |
| Comparative example 44 | Comparative developer 44 | Comparative toner 9 | 6 | | | | D | D | D | D |
| Comparative example 45 | Comparative developer 45 | Comparative toner 10 | 0 | 0.7 | | | D | D | D | D |
| Example 7 | Developer 7 | Toner 7 | 0.5 | | | | B | B | B+ | B+ |
| Example 8 | Developer 8 | Toner 8 | 2 | | | | B | B | B+ | B+ |
| Example 9 | Developer 9 | Toner 9 | 5 | | | | B | B | B+ | B+ |
| Comparative example 46 | Comparative developer 46 | Comparative toner 11 | 6 | | | | D | D | D | D |
| Comparative example 47 | Comparative developer 47 | Comparative toner 12 | 0 | 0.9 | | | D | D | D | D |
| Example 10 | Developer 10 | Toner 10 | 0.5 | | | | B | B | B+ | B+ |
| Example 11 | Developer 11 | Toner 11 | 2 | | | | A | A | A | A |
| Example 12 | Developer 12 | Toner 12 | 5 | | | | B | B | B+ | B+ |
| Comparative example 48 | Comparative developer 48 | Comparative toner 13 | 6 | | | | D | D | D | D |
| Comparative example 49 | Comparative developer 49 | Comparative toner 14 | 0 | 1.2 | | | D | D | D | D |
| Example 13 | Developer 13 | Toner 13 | 0.5 | | | | B | B | B+ | B+ |
| Example 14 | Developer 14 | Toner 14 | 2 | | | | B | B | B+ | B+ |
| Example 15 | Developer 15 | Toner 15 | 5 | | | | B | B | B+ | B+ |
| Comparative example 50 | Comparative developer 50 | Comparative toner 15 | 6 | | | | D | D | D | D |
| Comparative example 51 | Comparative developer 51 | Comparative toner 16 | 0 | 1.3 | | | D | D | D | D |
| Comparative example 52 | Comparative developer 52 | Comparative toner 17 | 0.5 | | | | C | C | C | C |
| Comparative example 53 | Comparative developer 53 | Comparative toner 18 | 2 | | | | C | C | C | C |
| Comparative example 54 | Comparative developer 54 | Comparative toner 19 | 5 | | | | C | C | C | C |
| Comparative example 55 | Comparative developer 55 | Comparative toner 20 | 6 | | | | D | D | D | D |

TABLE 3

| | Developer | Toner | Amount of pigment exposed (%) | C/D | Carrier | Content of siloxane oligomer (ppm) | Deletion | Color spots | Density stability | Initial fogging after being kept to stand |
|---|---|---|---|---|---|---|---|---|---|---|
| Comparative example 56 | Comparative developer 56 | Comparative toner 1 | 0 | 0.05 | Carrier 2 | 100 | D | D | D | D |
| Comparative example 57 | Comparative developer 57 | Comparative toner 2 | 0.5 | | | | C | C | C | C |
| Comparative example 58 | Comparative developer 58 | Comparative toner 3 | 2 | | | | B | B | B+ | C |
| Comparative example 59 | Comparative developer 59 | Comparative toner 4 | 5 | | | | C | C | C | C |
| Comparative example 60 | Comparative developer 60 | Comparative toner 5 | 6 | | | | D | D | D | D |
| Comparative example 61 | Comparative developer 61 | Comparative toner 6 | 0 | 0.1 | | | D | D | D | D |
| Example 16 | Developer 16 | Toner 1 | 0.5 | | | | B | B | B+ | B+ |
| Example 17 | Developer 17 | Toner 2 | 2 | | | | B | B | B+ | B+ |
| Example 18 | Developer 18 | Toner 3 | 5 | | | | B | B | B+ | B+ |
| Comparative example 62 | Comparative developer 62 | Comparative toner 7 | 6 | | | | D | D | D | D |
| Comparative example 63 | Comparative developer 63 | Comparative toner 8 | 0 | 0.4 | | | D | D | D | D |
| Example 19 | Developer 19 | Toner 4 | 0.5 | | | | A | A | A | B+ |
| Example 20 | Developer 20 | Toner 5 | 2 | | | | A | A | A | A |
| Example 21 | Developer 21 | Toner 6 | 5 | | | | A | A | A | B+ |
| Comparative example 64 | Comparative developer 64 | Comparative toner 9 | 6 | | | | D | D | D | D |
| Comparative example 65 | Comparative developer 65 | Comparative toner 10 | 0 | 0.7 | | | D | D | D | D |
| Example 22 | Developer 22 | Toner 7 | 0.5 | | | | B | B | B+ | B+ |
| Example 23 | Developer 23 | Toner 8 | 2 | | | | B | B | B+ | B+ |
| Example 24 | Developer 24 | Toner 9 | 5 | | | | B | B | B+ | B+ |
| Comparative example 66 | Comparative developer 66 | Comparative toner 11 | 6 | | | | D | D | D | D |
| Comparative example 67 | Comparative developer 67 | Comparative toner 12 | 0 | 0.9 | | | D | D | D | D |
| Example 25 | Developer 25 | Toner 10 | 0.5 | | | | B | B | B+ | B+ |
| Example 26 | Developer 26 | Toner 11 | 2 | | | | A | A | A | A |
| Example 27 | Developer 27 | Toner 12 | 5 | | | | B | B | B+ | B+ |
| Comparative example 68 | Comparative developer 68 | Comparative toner 13 | 6 | | | | D | D | D | D |
| Comparative example 69 | Comparative developer 69 | Comparative toner 14 | 0 | 1.2 | | | D | D | D | D |
| Example 28 | Developer 28 | Toner 13 | 0.5 | | | | B | B | B+ | B+ |
| Example 29 | Developer 29 | Toner 14 | 2 | | | | A | A | A | B+ |
| Example 30 | Developer 30 | Toner 15 | 5 | | | | B | B | B+ | B+ |
| Comparative example 70 | Comparative developer 70 | Comparative toner 15 | 6 | | | | D | D | D | D |
| Comparative example 71 | Comparative developer 71 | Comparative toner 16 | 0 | 1.3 | | | D | D | D | D |
| Comparative example 72 | Comparative developer 72 | Comparative toner 17 | 0.5 | | | | C | C | C | C |
| Comparative example 73 | Comparative developer 73 | Comparative toner 18 | 2 | | | | B | B | B+ | C |
| Comparative example 74 | Comparative developer 74 | Comparative toner 19 | 5 | | | | C | C | C | C |
| Comparative example 75 | Comparative developer 75 | Comparative toner 20 | 6 | | | | D | D | D | D |

TABLE 4

| | Developer | Toner | Amount of pigment exposed (%) | C/D | Carrier | Content of siloxane oligomer (ppm) | Deletion | Color spots | Density stability | Initial fogging after being kept to stand |
|---|---|---|---|---|---|---|---|---|---|---|
| Comparative example 76 | Comparative developer 76 | Comparative toner 1 | 0 | 0.05 | Carrier 3 | 500 | D | D | D | D |
| Comparative example 77 | Comparative developer 77 | Comparative toner 2 | 0.5 | | | | D | D | D | C |
| Comparative example 78 | Comparative developer 78 | Comparative toner 3 | 2 | | | | D | D | D | B+ |
| Comparative example 79 | Comparative developer 79 | Comparative toner 4 | 5 | | | | D | D | D | C |

TABLE 4-continued

| | Developer | Toner | Amount of pigment exposed (%) | C/D | Carrier | Content of siloxane oligomer (ppm) | Deletion | Color spots | Density stability | Initial fogging after being kept to stand |
|---|---|---|---|---|---|---|---|---|---|---|
| Comparative example 80 | Comparative developer 80 | Comparative toner 5 | 6 | | | | D | D | D | D |
| Comparative example 81 | Comparative developer 81 | Comparative toner 6 | 0 | 0.1 | | | D | D | D | D |
| Example 31 | Developer 31 | Toner 1 | 0.5 | | | | B | B | B+ | B+ |
| Example 32 | Developer 32 | Toner 2 | 2 | | | | B | B | B+ | B+ |
| Example 33 | Developer 33 | Toner 3 | 5 | | | | B | B | B+ | B+ |
| Comparative example 82 | Comparative developer 82 | Comparative toner 7 | 6 | | | | D | D | D | D |
| Comparative example 83 | Comparative developer 83 | Comparative toner 8 | 0 | 0.4 | | | D | D | D | D |
| Example 34 | Developer 34 | Toner 4 | 0.5 | | | | B | B | B+ | B+ |
| Example 35 | Developer 35 | Toner 5 | 2 | | | | A | A | A | A |
| Example 36 | Developer 36 | Toner 6 | 5 | | | | B | B | B+ | B+ |
| Comparative example 84 | Comparative developer 84 | Comparative toner 9 | 6 | | | | D | D | D | D |
| Comparative example 85 | Comparative developer 85 | Comparative toner 10 | 0 | 0.7 | | | D | D | D | D |
| Example 37 | Developer 37 | Toner 7 | 0.5 | | | | B | B | B+ | B+ |
| Example 38 | Developer 38 | Toner 8 | 2 | | | | B | B | B+ | B+ |
| Example 39 | Developer 39 | Toner 9 | 5 | | | | B | B | B+ | B+ |
| Comparative example 86 | Comparative developer 86 | Comparative toner 11 | 6 | | | | D | D | D | D |
| Comparative example 87 | Comparative developer 87 | Comparative toner 12 | 0 | 0.9 | | | D | D | D | D |
| Example 40 | Developer 40 | Toner 10 | 0.5 | | | | B | B | B+ | B+ |
| Example 41 | Developer 41 | Toner 11 | 2 | | | | A | A | A | A |
| Example 42 | Developer 42 | Toner 12 | 5 | | | | B | B | B+ | B+ |
| Comparative example 88 | Comparative developer 88 | Comparative toner 13 | 6 | | | | D | D | D | D |
| Comparative example 89 | Comparative developer 89 | Comparative toner 14 | 0 | 1.2 | | | D | D | D | D |
| Example 43 | Developer 43 | Toner 13 | 0.5 | | | | B | B | B+ | B+ |
| Example 44 | Developer 44 | Toner 14 | 2 | | | | B | B | B+ | B+ |
| Example 45 | Developer 45 | Toner 15 | 5 | | | | B | B | B+ | B+ |
| Comparative example 90 | Comparative developer 90 | Comparative toner 15 | 6 | | | | D | D | D | D |
| Comparative example 91 | Comparative developer 91 | Comparative toner 16 | 0 | 1.3 | | | D | D | D | D |
| Comparative example 92 | Comparative developer 92 | Comparative toner 17 | 0.5 | | | | D | D | D | C |
| Comparative example 93 | Comparative developer 93 | Comparative toner 18 | 2 | | | | D | D | D | B+ |
| Comparative example 94 | Comparative developer 94 | Comparative toner 19 | 5 | | | | D | D | D | C |
| Comparative example 95 | Comparative developer 95 | Comparative toner 20 | 6 | | | | D | D | D | D |

TABLE 5

| | Developer | Toner | Amount of pigment exposed (%) | C/D | Carrier | Content of siloxane oligomer (ppm) | Deletion | Color spots | Density stability | Initial fogging after being kept to stand |
|---|---|---|---|---|---|---|---|---|---|---|
| Comparative example 96 | Comparative developer 96 | Comparative toner 1 | 0 | 0.05 | Comparative Carrier 2 | 600 | D | D | D | D |
| Comparative example 97 | Comparative developer 97 | Comparative toner 2 | 0.5 | | | | D | D | D | D |
| Comparative example 98 | Comparative developer 98 | Comparative toner 3 | 2 | | | | C | C | C | D |
| Comparative example 99 | Comparative developer 99 | Comparative toner 4 | 5 | | | | D | D | D | D |
| Comparative example 100 | Comparative developer 100 | Comparative toner 5 | 6 | | | | D | D | D | D |
| Comparative example 101 | Comparative developer 101 | Comparative toner 6 | 0 | 0.1 | | | D | D | D | D |
| Comparative example 102 | Comparative developer 102 | Toner 1 | 0.5 | | | | D | D | D | D |
| Comparative example 103 | Comparative developer 103 | Toner 2 | 2 | | | | C | C | C | D |

TABLE 5-continued

| | Developer | Toner | Amount of pigment exposed (%) | C/D | Carrier | Content of siloxane oligomer (ppm) | Deletion | Color spots | Density stability | Initial fogging after being kept to stand |
|---|---|---|---|---|---|---|---|---|---|---|
| Comparative example 104 | Comparative developer 104 | Toner 3 | 5 | | | | C | C | C | D |
| Comparative example 105 | Comparative developer 105 | Comparative toner 7 | 6 | | | | D | D | D | D |
| Comparative example 106 | Comparative developer 106 | Comparative toner 8 | 0 | 0.4 | | | D | D | D | D |
| Comparative example 107 | Comparative developer 107 | Toner 4 | 0.5 | | | | C | C | C | C |
| Comparative example 108 | Comparative developer 108 | Toner 5 | 2 | | | | C | C | C | C |
| Comparative example 109 | Comparative developer 109 | Toner 6 | 5 | | | | C | C | C | C |
| Comparative example 110 | Comparative developer 110 | Comparative toner 9 | 6 | | | | D | D | D | D |
| Comparative example 111 | Comparative developer 111 | Comparative toner 10 | 0 | 0.7 | | | D | D | D | D |
| Comparative example 112 | Comparative developer 112 | Toner 7 | 0.5 | | | | D | D | D | C |
| Comparative example 113 | Comparative developer 113 | Toner 8 | 2 | | | | C | C | C | C |
| Comparative example 114 | Comparative developer 114 | Toner 9 | 5 | | | | D | D | D | C |
| Comparative example 115 | Comparative developer 115 | Comparative toner 11 | 6 | | | | D | D | D | D |
| Comparative example 116 | Comparative developer 116 | Comparative toner 12 | 0 | 0.9 | | | D | D | D | D |
| Comparative example 117 | Comparative developer 117 | Toner 10 | 0.5 | | | | C | C | C | C |
| Comparative example 118 | Comparative developer 118 | Toner 11 | 2 | | | | C | C | C | C |
| Comparative example 119 | Comparative developer 119 | Toner 12 | 5 | | | | C | C | C | C |
| Comparative example 120 | Comparative developer 120 | Comparative toner 13 | 6 | | | | D | D | D | D |
| Comparative example 121 | Comparative developer 121 | Comparative toner 14 | 0 | 1.2 | | | D | D | D | D |
| Comparative example 122 | Comparative developer 122 | Toner 13 | 0.5 | | | | C | C | C | C |
| Comparative example 123 | Comparative developer 123 | Toner 14 | 2 | | | | C | C | C | C |
| Comparative example 124 | Comparative developer 124 | Toner 15 | 5 | | | | C | C | C | C |
| Comparative example 125 | Comparative developer 125 | Comparative toner 15 | 6 | | | | D | D | D | D |
| Comparative example 126 | Comparative developer 126 | Comparative toner 16 | 0 | 1.3 | | | D | D | D | D |
| Comparative example 127 | Comparative developer 127 | Comparative toner 17 | 0.5 | | | | D | D | D | C |
| Comparative example 128 | Comparative developer 128 | Comparative toner 18 | 2 | | | | C | C | C | C |
| Comparative example 129 | Comparative developer 129 | Comparative toner 19 | 5 | | | | D | D | D | C |
| Comparative example 130 | Comparative developer 130 | Comparative toner 20 | 6 | | | | D | D | D | D |

TABLE 6

| | Developer | Toner | Amount of pigment exposed (%) | C/D | Carrier | Content of siloxane oligomer (ppm) | Deletion | Color spots | Density stability | Initial fogging after being kept to stand |
|---|---|---|---|---|---|---|---|---|---|---|
| Comparative example 131 | Comparative developer 131 | Comparative toner 1 | 0 | 0.05 | Carrier 4 | 100 | D | D | D | D |
| Comparative example 132 | Comparative developer 132 | Comparative toner 2 | 0.5 | | | | C | C | C | C |
| Comparative example 133 | Comparative developer 133 | Comparative toner 3 | 2 | | | | B | B | B+ | C |
| Comparative example 134 | Comparative developer 134 | Comparative toner 4 | 5 | | | | C | C | C | C |
| Comparative example 135 | Comparative developer 135 | Comparative toner 5 | 6 | | | | D | D | D | D |

TABLE 6-continued

| | Developer | Toner | Amount of pigment exposed (%) | C/D | Carrier | Content of siloxane oligomer (ppm) | Deletion | Color spots | Density stability | Initial fogging after being kept to stand |
|---|---|---|---|---|---|---|---|---|---|---|
| Comparative example 136 | Comparative developer 136 | Comparative toner 6 | 0 | 0.1 | | | D | D | D | D |
| Example 46 | Developer 46 | Toner 1 | 0.5 | | | | B | B | B+ | B+ |
| Example 47 | Developer 47 | Toner 2 | 2 | | | | B | B | B+ | B+ |
| Example 48 | Developer 48 | Toner 3 | 5 | | | | B | B | B+ | B+ |
| Comparative example 137 | Comparative developer 137 | Comparative toner 7 | 6 | | | | D | D | D | D |
| Comparative example 138 | Comparative developer 138 | Comparative toner 8 | 0 | 0.4 | | | D | D | D | D |
| Example 49 | Developer 49 | Toner 4 | 0.5 | | | | A | A | A | B+ |
| Example 50 | Developer 50 | Toner 5 | 2 | | | | A | A | A | A |
| Example 51 | Developer 51 | Toner 6 | 5 | | | | A | A | A | B+ |
| Comparative example 139 | Comparative developer 139 | Comparative toner 9 | 6 | | | | D | D | D | D |
| Comparative example 140 | Comparative developer 140 | Comparative toner 10 | 0 | 0.7 | | | D | D | D | D |
| Example 52 | Developer 52 | Toner 7 | 0.5 | | | | B | B | B+ | B+ |
| Example 53 | Developer 53 | Toner 8 | 2 | | | | B | B | B+ | B+ |
| Example 54 | Developer 54 | Toner 9 | 5 | | | | B | B | B+ | B+ |
| Comparative example 141 | Comparative developer 141 | Comparative toner 11 | 6 | | | | D | D | D | D |
| Comparative example 142 | Comparative developer 142 | Comparative toner 12 | 0 | 0.9 | | | D | D | D | D |
| Example 55 | Developer 55 | Toner 10 | 0.5 | | | | B | B | B+ | B+ |
| Example 56 | Developer 56 | Toner 11 | 2 | | | | A | A | A | A |
| Example 57 | Developer 57 | Toner 12 | 5 | | | | B | B | B+ | B+ |
| Comparative example 143 | Comparative developer 143 | Comparative toner 13 | 6 | | | | D | D | D | D |
| Comparative example 144 | Comparative developer 144 | Comparative toner 14 | 0 | 1.2 | | | D | D | D | D |
| Example 58 | Developer 58 | Toner 13 | 0.5 | | | | B | B | B+ | B+ |
| Example 59 | Developer 59 | Toner 14 | 2 | | | | A | A | A | B+ |
| Example 60 | Developer 60 | Toner 15 | 5 | | | | B | B | B+ | B+ |
| Comparative example 145 | Comparative developer 145 | Comparative toner 15 | 6 | | | | D | D | D | D |
| Comparative example 146 | Comparative developer 146 | Comparative toner 16 | 0 | 1.3 | | | D | D | D | D |
| Comparative example 147 | Comparative developer 147 | Comparative toner 17 | 0.5 | | | | C | C | C | C |
| Comparative example 148 | Comparative developer 148 | Comparative toner 18 | 2 | | | | B | B | B+ | C |
| Comparative example 149 | Comparative developer 149 | Comparative toner 19 | 5 | | | | C | C | C | C |
| Comparative example 150 | Comparative developer 150 | Comparative toner 20 | 6 | | | | D | D | D | D |

TABLE 7

| | Developer | Toner | Amount of pigment exposed (%) | C/D | Carrier | Content of siloxane oligomer (ppm) | Deletion | Color spots | Density stability | Initial fogging after being kept to stand |
|---|---|---|---|---|---|---|---|---|---|---|
| Comparative example 151 | Comparative developer 151 | Comparative toner 1 | 0 | 0.05 | Carrier 5 | 100 | D | D | D | D |
| Comparative example 152 | Comparative developer 152 | Comparative toner 2 | 0.5 | | | | C | C | D | C |
| Comparative example 153 | Comparative developer 153 | Comparative toner 3 | 2 | | | | B | B | C | C |
| Comparative example 154 | Comparative developer 154 | Comparative toner 4 | 5 | | | | C | C | C | C |
| Comparative example 155 | Comparative developer 155 | Comparative toner 5 | 6 | | | | D | D | D | D |
| Comparative example 156 | Comparative developer 156 | Comparative toner 6 | 0 | 0.1 | | | D | D | D | D |
| Example 61 | Developer 61 | Toner 1 | 0.5 | | | | B | B | B− | B− |
| Example 62 | Developer 62 | Toner 2 | 2 | | | | B | B | B− | B− |
| Example 63 | Developer 63 | Toner 3 | 5 | | | | B | B | B− | B− |
| Comparative example 157 | Comparative developer 157 | Comparative toner 7 | 6 | | | | D | D | D | D |
| Comparative example 158 | Comparative developer 158 | Comparative toner 8 | 0 | 0.4 | | | D | D | D | D |

TABLE 7-continued

| | Developer | Toner | Amount of pigment exposed (%) | C/D | Carrier | Content of siloxane oligomer (ppm) | Deletion | Color spots | Density stability | Initial fogging after being kept to stand |
|---|---|---|---|---|---|---|---|---|---|---|
| Example 64 | Developer 64 | Toner 4 | 0.5 | | | | A | A | B− | B− |
| Example 65 | Developer 65 | Toner 5 | 2 | | | | A | A | B− | B+ |
| Example 66 | Developer 66 | Toner 6 | 5 | | | | A | A | B− | B− |
| Comparative example 159 | Comparative developer 159 | Comparative toner 9 | 6 | | | | D | D | D | D |
| Comparative example 160 | Comparative developer 160 | Comparative toner 10 | 0 | 0.7 | | | D | D | D | D |
| Example 67 | Developer 67 | Toner 7 | 0.5 | | | | B | B | B− | B− |
| Example 68 | Developer 68 | Toner 8 | 2 | | | | B | B | B− | B− |
| Example 69 | Developer 69 | Toner 9 | 5 | | | | B | B | B− | B− |
| Comparative example 161 | Comparative developer 161 | Comparative toner 11 | 6 | | | | D | D | D | D |
| Comparative example 162 | Comparative developer 162 | Comparative toner 12 | 0 | 0.9 | | | D | D | D | D |
| Example 70 | Developer 70 | Toner 10 | 0.5 | | | | B | B | B+ | B− |
| Example 71 | Developer 71 | Toner 11 | 2 | | | | A | A | B− | B− |
| Example 72 | Developer 72 | Toner 12 | 5 | | | | B | B | B− | B− |
| Comparative example 163 | Comparative developer 163 | Comparative toner 13 | 6 | | | | D | D | D | D |
| Comparative example 164 | Comparative developer 164 | Comparative toner 14 | 0 | 1.2 | | | D | D | D | D |
| Example 73 | Developer 73 | Toner 13 | 0.5 | | | | B | B | B− | B− |
| Example 74 | Developer 74 | Toner 14 | 2 | | | | A | A | B− | B− |
| Example 75 | Developer 75 | Toner 15 | 5 | | | | B | B | B− | B− |
| Comparative example 165 | Comparative developer 165 | Comparative toner 15 | 6 | | | | D | D | D | D |
| Comparative example 166 | Comparative developer 166 | Comparative toner 16 | 0 | 1.3 | | | D | D | D | D |
| Comparative example 167 | Comparative developer 167 | Comparative toner 17 | 0.5 | | | | C | C | C | C |
| Comparative example 168 | Comparative developer 168 | Comparative toner 18 | 2 | | | | B | B | B+ | C |
| Comparative example 169 | Comparative developer 169 | Comparative toner 19 | 5 | | | | C | C | C | C |
| Comparative example 170 | Comparative developer 170 | Comparative toner 20 | 6 | | | | D | D | D | D |

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrostatic charge image developer comprising:

a toner that includes a toner particle; and a carrier, wherein the toner particle contains a brilliant pigment that consists of a metal element, an exposed amount of the brilliant pigment is from 0.5 atomic % to 5 atomic % of the toner particle surface as measured by X-ray photoelectron spectroscopy, the carrier has a core particle and a coating layer which covers a surface of the core particle, the coating layer contains a silicone resin and a siloxane oligomer, and a content of the siloxane oligomer is from 0.1 ppm to 500 ppm with respect to a total weight of the coating layer.

2. The electrostatic charge image developer according to claim 1, wherein the exposed amount of the brilliant pigment is from 0.8 atomic % to 4.5 atomic %.

3. The electrostatic charge image developer according to claim 1, wherein a weight-average molecular weight of the siloxane oligomer is 300 or more and less than 5,000.

4. The electrostatic charge image developer according to claim 1, wherein a content of the siloxane oligomer is from 1 ppm to 450 ppm with respect to a total weight of the coating layer.

5. The electrostatic charge image developer according to claim 1, wherein the exposed amount of the brilliant pigment is from 1 atomic % to 4 atomic %.

6. The electrostatic charge image developer according to claim 1, wherein a ratio (C/D) between a number-average maximum thickness C and a number-average equivalent circle diameter D of the toner particles is 0.1 or more and less than 0.7.

7. The electrostatic charge image developer according to claim 1, wherein a ratio (C/D) between the number-average maximum thickness C and the number-average equivalent circle diameter D of the toner particles is from 0.7 to 1.2.

8. A developer cartridge comprising:

a container that contains the electrostatic charge image developer according to claim 1, wherein the developer cartridge is detachable from an image forming apparatus.

9. A process cartridge comprising:

a container that contains the electrostatic charge image developer according to claim 1, and a developer holding member that holds the electrostatic charge image developer, wherein the process cartridge is detachable from an image forming apparatus.

10. The electrostatic charge image developer according to claim 1, wherein the metal element is selected from the group consisting of aluminum, nickel, zinc, copper, silver, gold, and platinum.

11. The electrostatic charge image developer according to claim 1, wherein the metal element is aluminum.

* * * * *